US010589885B2

(12) United States Patent
Hashimoto et al.

(10) Patent No.: US 10,589,885 B2
(45) Date of Patent: Mar. 17, 2020

(54) FILM ROLL SUPPORT DEVICE

(71) Applicant: ISHIDA CO., LTD., Kyoto-shi, Kyoto (JP)

(72) Inventors: Satoshi Hashimoto, Ritto (JP); Ryota Nagashima, Ritto (JP); Takafumi Shimoda, Ritto (JP); Ryo Sasaki, Ritto (JP); Hiroki Fujihara, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 112 days.

(21) Appl. No.: 15/555,978

(22) PCT Filed: Jan. 26, 2016

(86) PCT No.: PCT/JP2016/052194
§ 371 (c)(1),
(2) Date: Sep. 6, 2017

(87) PCT Pub. No.: WO2016/147701
PCT Pub. Date: Sep. 22, 2016

(65) Prior Publication Data

US 2018/0079542 A1 Mar. 22, 2018

(30) Foreign Application Priority Data

Mar. 19, 2015 (JP) ..... 2015-056140

(51) Int. Cl.
*B65B 41/16* (2006.01)
*B65H 16/04* (2006.01)
(Continued)

(52) U.S. Cl.
CPC ..... *B65B 41/16* (2013.01); *B65B 41/12* (2013.01); *B65H 16/02* (2013.01); *B65H 16/04* (2013.01); *B65H 19/12* (2013.01); *B65H 19/123* (2013.01)

(58) Field of Classification Search
CPC ..... B65H 16/04; B65H 19/12; B65H 16/103; B65H 19/123; B65H 16/02; B65H 16/023;
(Continued)

(56) References Cited

U.S. PATENT DOCUMENTS 1,179,924 A 4/1916 Howell
2,392,966 A 1/1946 Baia
(Continued)

FOREIGN PATENT DOCUMENTS

JP H02-165813 A 6/1990
JP H11-79479 A 3/1999
(Continued)

OTHER PUBLICATIONS

The Search Report from the corresponding European Patent Application No. 16764532.4 dated Feb. 13, 2018.
(Continued)

*Primary Examiner* — Michael R Mansen
*Assistant Examiner* — Raveen J Dias
(74) *Attorney, Agent, or Firm* — Shinjyu Global IP

(57) ABSTRACT

A film roll supporting device comprises a shaft body part, a shaft tip part, and a projection part. The shaft body part extends through a central hole of a film roll and having the film roll mounted thereon. The shaft tip part extends in an axis direction of a shaft from one end of the shaft body part on a side to be inserted into the central hole of the film roll. The projection part extends in a direction intersecting the axis direction of the shaft body part from the shaft tip part. The projection part abuts from below to a core of the film roll provisionally placed on the shaft tip part when the mounting of the film roll is performed. A cutout recessed in a direction intersecting the axis direction of the shaft body part is formed in the projection part.

14 Claims, 24 Drawing Sheets

(51) Int. Cl.
*B65H 19/12* (2006.01)
*B65B 41/12* (2006.01)
*B65H 16/02* (2006.01)

(58) Field of Classification Search
CPC ..... B65H 16/10; B65H 49/26; B65H 49/305; B65H 49/34; B65H 49/36; B65H 49/32; B65H 18/06; B65H 18/026; B65H 18/02; B65H 75/18; B65H 75/242; B65H 75/246; B65H 2301/413; B65H 2301/41308; B65H 2301/41312; B65H 2301/4132; B65H 2301/413223; B65H 2301/4133; B65H 2301/41335; B65H 2301/4135; B65H 2301/41352; B65H 2301/4136; B65H 2301/41366; B65B 41/16; B65B 41/12; B65B 41/00; B65B 61/00; B65B 57/00
See application file for complete search history.

(56) References Cited

U.S. PATENT DOCUMENTS 2,981,496 A * 4/1961 Harmon ..... B65H 49/26 242/129.8
3,738,588 A * 6/1973 Ayers ..... B65H 23/06 242/423.1
3,791,659 A * 2/1974 Hardin ..... B23B 31/4046 242/573.9
4,157,793 A 6/1979 Lucia
4,896,842 A * 1/1990 Heinz ..... B65B 41/12 242/559.1
5,274,984 A * 1/1994 Fukuda ..... B65B 9/20 242/559.3
5,628,474 A * 5/1997 Krueger ..... A47K 10/38 242/559.4
5,645,247 A 7/1997 Voigt
6,302,604 B1 * 10/2001 Bryant ..... B41J 15/02 101/288
2001/0035474 A1 * 11/2001 Kury ..... B65H 19/2215 242/533.4
2005/0258301 A1 * 11/2005 Hirte ..... B65H 16/04 242/597.6
2009/0072073 A1 * 3/2009 Campbell ..... B65H 16/04 242/597
2012/0211585 A1 * 8/2012 Kim ..... B65H 16/04 242/586
2013/0032293 A1 * 2/2013 Birkle ..... B31D 5/0073 156/538
2013/0047554 A1 * 2/2013 Bertram ..... B65H 23/182 53/452
2015/0075114 A1 * 3/2015 Murch ..... B29D 22/02 53/52
2015/0239592 A1 * 8/2015 Wetsch ..... B65B 51/10 53/79
2015/0266604 A1 * 9/2015 Amano ..... B65B 61/26 53/65

FOREIGN PATENT DOCUMENTS

JP 2000-508284 A 7/2000
JP 2012-136343 A 7/2012

OTHER PUBLICATIONS

The Search Report from the corresponding International Patent Application No. PCT/JP2016/052194 dated Apr. 19, 2016.
The Preliminary Report on Patentability (with Written Opinion) from the corresponding International Patent Application No. PCT/JP2016/052194 dated Sep. 28, 2017.

* cited by examiner

FILM ROLL SUPPORT DEVICE

PRIORITY

This is a National Stage Application under 35 U.S.C. § 371 of International Application PCT/JP2016/052194, with an international filing date of Jan. 26, 2016, which claims priority to Japanese Patent Application No. 2015-056140 filed on Mar. 19, 2015. The entire disclosures of International Application PCT/JP2016/052194 and Japanese Patent Application No. 2015-056140 are hereby incorporated herein by reference.

TECHNICAL FIELD

Certain implementations relate to a film roll supporting device.

BACKGROUND

Known in the art is a film roll supporting device supporting a film roll having a film wound in a roll on a shaft extending through this film roll. For example, a film roll supporting device that has a shaft, which is extending through a film roll, may be provided with catching members for catching the film roll at an installation position.

SUMMARY

The mounting operation of a film roll on a film roll supporting device is commonly performed as follows: a core of the film roll is held by both hands; a portion of the film roll is inserted onto one end of a shaft via a central hole thereof and is provisionally placed thereon; thereafter, the entire of the film roll is slid to an installation position (in the direction of the other end of the shaft).

However, during the above operation, the operability may degrades depending on the weight of the film roll or the shape of the shaft. For example, the film roll may not be easily inserted onto the one end of the shaft, or the portion of the film roll is inserted onto the one end of the shaft, but may not be easily provisionally placed thereon. Moreover, when the portion of the film roll is provisionally placed thereon, the film roll may be displaced and fall in the direction opposite to the installation position.

An object of certain implementations is to provide a film roll supporting device which is excellent in the operability in the mounting operation of the film roll.

A film roll supporting device according to a first aspect of the present invention is a film roll supporting device supporting a film roll having a film wound around a core. The film roll supporting device comprises a shaft body part, a shaft tip part, and a projection part. The shaft body part extends through a central hole of the film roll. The shaft body part has the film roll mounted thereon. The shaft tip part extends in an axis direction of the shaft body part from one end of the shaft body part on the side from which the central hole of the film roll being introduced. The projection part extends in a direction intersecting the axis direction of the shaft body part from the shaft tip part. The projection part abuts from below to the core of the film roll provisionally placed on the shaft tip part when the mounting of the film roll is performed. At least one cutout is formed in the projection part. The cutout is recessed in a direction intersecting the axis direction of the shaft body part.

Since the film roll supporting device according to the first aspect of the present invention comprises the projection part, when a portion of the film roll is provisionally placed on the shaft tip part, a clearance equivalent to a distance between a tip of the projection part and the shaft tip part is left between the core and the shaft tip part in the central hole disposed on the shaft tip part. Consequently, in the state in which the core of the film roll is placed on the projection part, it is easy for a holding hand (including fingers) on the introduction side of the film roll to release from the core. Accordingly, in the mounting operation of the film roll, it is easy to provisionally place the film roll on the shaft tip part.

Moreover, since the cutout is formed in the projection part, when the film roll is inserted onto the shaft tip part, a movement path for the hand (including fingers) holding the film roll on the introduction direction side is formed in the projection part. Consequently, when the film roll is inserted onto the shaft tip part, the hand holding the film roll on the introduction direction side is able to pass the projection part via the cutout. Therefore, the contact between the hand holding the film roll and the projection part is restrained. Accordingly, it is easy to insert the film roll onto the shaft.

Therefore, the operability in the mounting operation of the film roll is enhanced.

A film roll supporting device according to a second aspect of the present invention is a film roll supporting device supporting a film roll having a film wound around a core. The film roll supporting device comprises a shaft body part, a shaft tip part, and a projection part. The shaft body part extends through a central hole of the film roll. The shaft body part has the film roll mounted thereon. The shaft tip part extends in an axis direction of the shaft body part from one end of the shaft body part on the side from which the central hole of the film roll being introduced. The projection part extends in a direction intersecting the axis direction of the shaft body part from the shaft tip part. The projection part abuts from below to the core of the film roll provisionally placed on the shaft tip part when the mounting of the film roll is performed. The shaft tip part has an upper surface extending at a height position lower than a central axis of the shaft body part in a state in which the projection part upwardly faces.

Since the film roll supporting device according to the second aspect of the present invention comprises the projection part, when the portion of the film roll is provisionally placed on the shaft tip part, a clearance equivalent to a distance between the tip of the projection part and the shaft tip part is left between the core and the shaft tip part in the central hole disposed on the shaft tip part. Consequently, in the state in which the core of the film roll is placed on the projection part, it is easy for a holding hand (including fingers) on the introduction side of the film roll to release from the core. Accordingly, in the mounting operation of the film roll, it is easy to provisionally place the film roll on the shaft tip part.

Moreover, since the shaft tip part has the upper surface extending at the height position lower than the central axis of the shaft body part in the state in which the projection part upwardly faces, in the state in which the core of the film roll is placed on the projection part, the space for accommodating the holding hand (including fingers) on the introduction side of the film roll is able to be left. Consequently, when the portion of the film roll is provisionally placed on the shaft tip part, the contact between the holding hand on the introduction side of the film roll and the projection part is restrained. Accordingly, in the mounting operation of the film roll, it is easy to provisionally place the film roll on the shaft tip part.

Therefore, the operability in the mounting operation of the film roll is enhanced.

A film roll supporting device according to a third aspect of the present invention is the film roll supporting device according to the second aspect of the present invention, in which at least one cutout recessed in a direction intersecting the axis direction of the shaft body part is formed in the projection part. According to this, when the film roll is inserted onto the shaft tip part, the movement path for the hand (including fingers) holding the film roll on the introduction direction side is formed in the projection part. Consequently, when the film roll is inserted onto the shaft tip part, the hand holding the film roll on the introduction direction side is able to pass the projection part via the cutout. Therefore, the contact between the hand holding the film roll and the projection part is restrained. Accordingly, it is easy to insert the film roll onto the shaft. Therefore, the operability in the mounting operation of the film roll is enhanced.

A film roll supporting device according to a fourth aspect of the present invention is the film roll supporting device according to the first or third aspect of the present invention, in which the shaft tip part is joined to the shaft body part relatively rotatably around the axis direction of the shaft body part. The projection part is configured integrally with the shaft tip part. The projection part rotates together with the shaft tip part. The center of gravity of the shaft tip part is positioned such that the projection part upwardly faces and the cutout is recessed downwardly when the shaft tip part is in a stationary state.

According to this, regardless of the rotation of the shaft body part, the cutout of the projection part is recessed downwardly. Consequently, when the mounting operation of the film roll is performed, it is not necessary to adjust the position of the shaft tip part before the operation. Moreover, if, during the operation, the shaft body part rotates due to the contact or the like, it is not necessary to stop the operation to adjust the position of the shaft tip part. Accordingly, the operability in the mounting operation of the film roll is enhanced.

A film roll supporting device according to a fifth aspect of the present invention is the film roll supporting device according to any of the first through fourth aspects of the present invention, in which the shaft tip part has a length in the axis direction longer than a length of the projection part in a longitudinal direction.

According to this, in the state in which the core of the film roll is placed on the projection part, it is possible to adequately largely leave the space for accommodating the hand (including fingers) holding the film roll on the introduction side. Consequently, when the portion of the film roll is provisionally placed on the shaft tip part, the contact between the holding hand on the introduction side of the film roll and the projection part is further restrained. Accordingly, in the mounting operation of the film roll, it is further easy to provisionally place the film roll on the shaft tip part. Therefore, the operability in the mounting operation of the film roll is further enhanced.

A film roll supporting device according to a sixth aspect of the present invention is the film roll supporting device according to any of the first through fifth aspects of the present invention, in which the projection part is rotatable around the axis direction of the shaft body part.

According to this, when the mounting operation of the film roll is performed, a position of the projection part is able to be adjusted as appropriate. That is to say, when the mounting operation of the film roll is performed, it is possible to adjust the position of the projection part so that the film roll is readily inserted onto the shaft tip part. Moreover, it is possible to adjust the position of the projection part so that the film roll is readily provisionally placed on the shaft tip part. Accordingly, the operability in the mounting operation of the film roll is further enhanced.

A film roll supporting device according to a seventh aspect of the present invention is the film roll supporting device according to any of the first through sixth aspects of the present invention, in which the shaft tip part includes a joining portion. The joining portion is joined to the shaft body part. The joining portion has a guide surface. The guide surface is downwardly inclined and extends toward the projection part in a stationary state. The guide surface abuts the film roll that is in movement to guide the film roll to the shaft body part side during the mounting of the film roll.

According to this, when the portion of the film roll is provisionally placed on the shaft tip part and the entire of the film roll is slid to the installation position, it is possible to perform smooth sliding without a force lifting the entire of the film roll. Accordingly, the operability in the mounting operation of the film roll is further enhanced.

A film roll supporting device according to an eighth aspect of the present invention is the film roll supporting device according to the seventh aspect of the present invention, in which the shaft tip part further includes an extending portion. The extending portion has a plate shape. The extending portion extends in a direction opposite to the shaft body part side from the joining portion. The projection part extends from the extending portion. The guide surface is inclined and extends to a portion connected to the extending portion.

According to this, in the state in which the core of the film roll is placed on the projection part, it is possible to further largely leave the space for accommodating the hand holding the film roll on the introduction side. Consequently, when the film roll is provisionally placed on the shaft tip part, the contact between the holding hand on the introduction side of the film roll and the projection part is further restrained. Accordingly, in the mounting operation of the film roll, it is further easy to provisionally place the film roll on the shaft tip part. Therefore, the operability in the mounting operation of the film roll is further enhanced.

A film roll supporting device according to a ninth aspect of the present invention is the film roll supporting device according to any of the first through eighth aspects of the present invention. The film roll supporting device further comprises a base part and a drive part. The base part is pivotally disposed on a frame. The other end of the shaft body part is secured to the base part. The drive part is positioned in the base part. The drive part allows the shaft body part to rotate around the axis direction. The shaft body part and the drive part pivot together with the base part.

Since the shaft body part pivots together with the base part, when the mounting operation of the film roll is performed, the shaft tip part is able to pivot to a position at which the film roll is readily inserted. Accordingly, the operability in the mounting operation of the film roll is further enhanced.

In certain implementations of the film roll supporting device, when the portion of the film roll is provisionally placed on the shaft tip part, a clearance equivalent to a distance between the tip of the projection part and the shaft tip part is left between the core and the shaft tip part in the central hole disposed on the shaft tip part. Consequently, in the state in which the core of the film roll is placed on the projection part, it is easy for a holding hand (including fingers) on the introduction side of the film roll to release from the core. Accordingly, in the mounting operation of the film roll, it is easy to provisionally place the film roll on the shaft tip part.

Moreover, when the film roll is inserted onto the shaft tip part, the movement path for the hand (including fingers) holding the film roll on the introduction direction side is formed in the projection part. Consequently, when the film roll is inserted onto the shaft tip part, the hand holding the film roll is able to pass the projection part via the cutout. Therefore, the contact between the hand holding the film roll and the projection part is restrained. Accordingly, it is easy to insert the film roll onto the shaft.

Therefore, the operability in the mounting operation of the film roll is enhanced.

DETAILED DESCRIPTION

Hereinafter, a film roll supporting device 10 according to an embodiment of the present invention will be described with reference to the drawings. It should be noted that the following embodiment is an illustrative embodiment of the present invention and is not intended to limit the technical scope of the present invention. The following embodiment may be modified as appropriate in a scope that does not depart from the gist of the invention. In the description below, the directions of "up", "down", "left", "right", "front (frontal)", and "back (rear)" indicate the directions as shown in FIGS. 1, 2, and 4 to 24 unless otherwise specified.

(1) Schematic Structure of Film Roll Supporting Device 10

Figure 1:
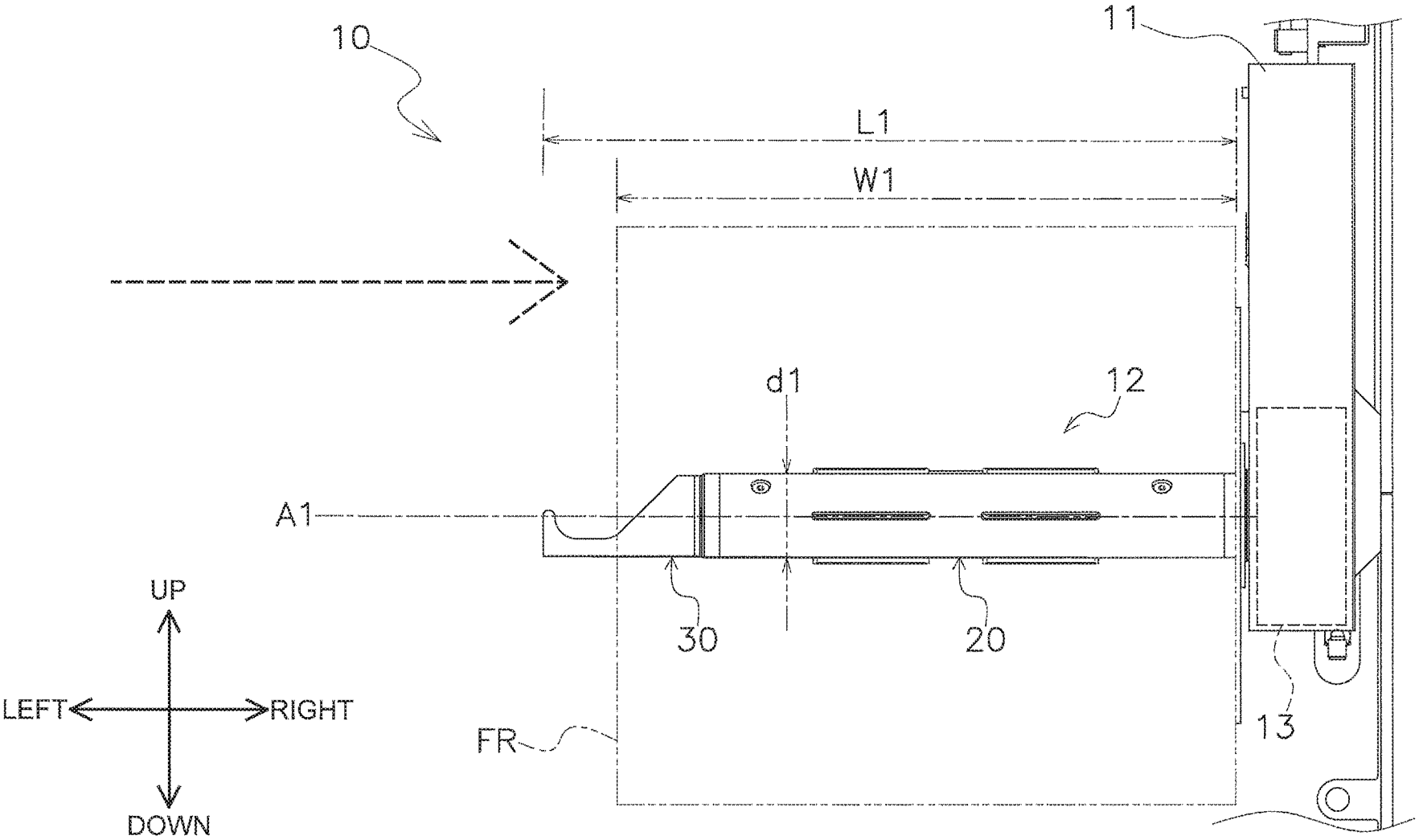
FIG. 1 is a schematic view of the structure of a film roll supporting device according to an embodiment of the present invention.
Figure 2:
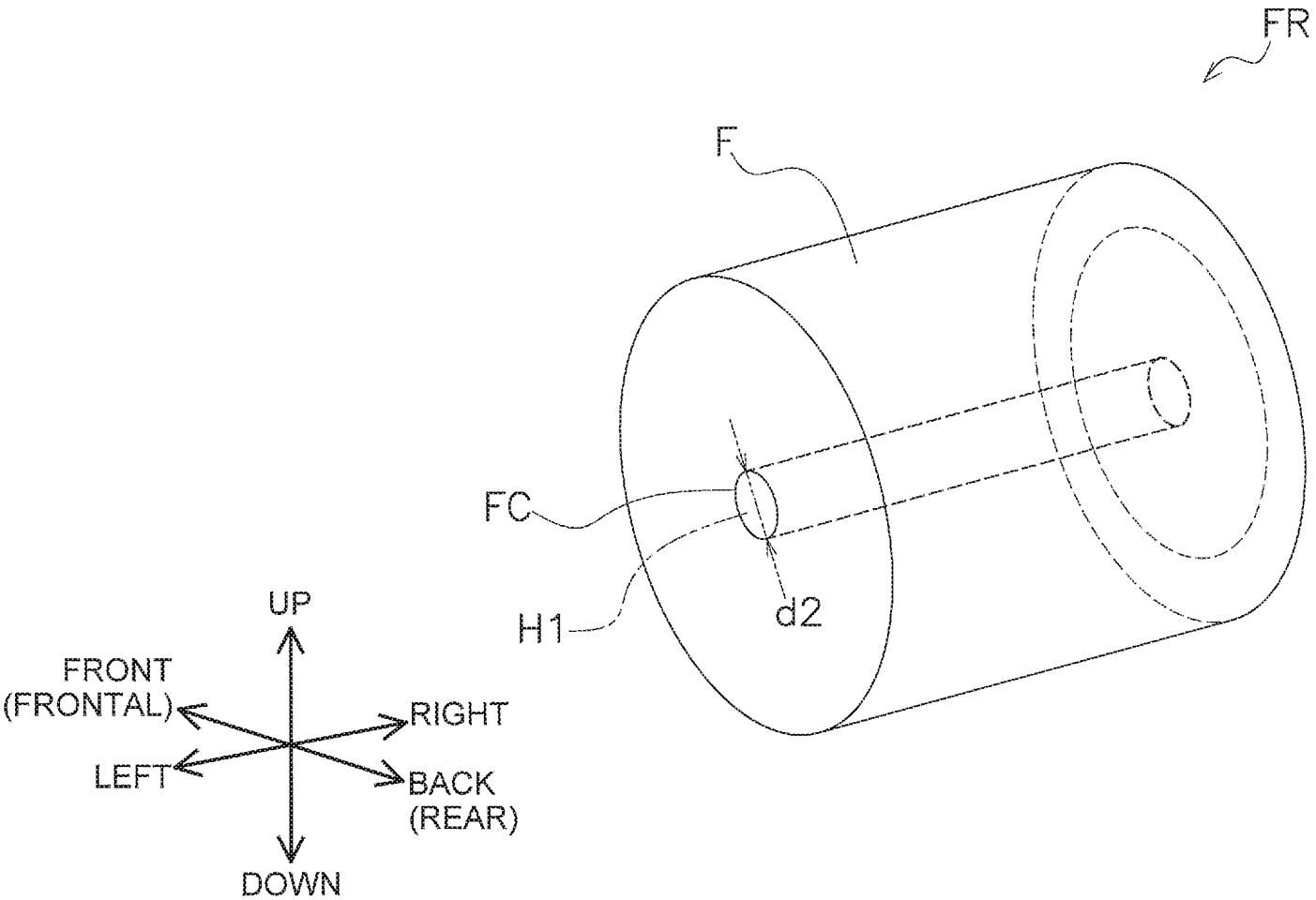
FIG. 2 schematically shows an example of a film roll.

FIG. 1 is a schematic view of the structure of the film roll supporting device 10. FIG. 2 schematically shows an example of a film roll FR.

The film roll supporting device 10 rotatably supports the film roll FR that is configured with a long film F wound around a tubular core FC as shown in FIG. 2. The film roll supporting device 10 includes a base part 11, a shaft 12, and a shaft motor 13 allowing the shaft 12 to rotate.

The base part 11 is a member made of metal, and rotatably retains the neighborhood of a terminal end of the shaft 12. The base part 11 houses and secures the shaft motor 13 therein.

A central hole H1 (i.e., the core FC) of the film roll FR is inserted onto the shaft 12 in the introduction direction (see the dashed line arrow in FIG. 1) in order for the film roll FR to be mounted on the shaft 12. The shaft 12 supports the film roll FR in the state of extending through the central hole H1. The shaft 12 is connected to an output shaft of the shaft motor 13 to rotate in synchronization with the driving of the shaft motor 13. The shaft 12 has a length L1 in an axis A1 direction (the left-and-right direction) longer than a width W1 (a length in the left-and-right direction) of the core FC. Moreover, the shaft 12 has a diameter d1 shorter than a diameter d2 of the core FC. The shaft 12 primarily includes a shaft body part 20 rotatably secured to the base part 11 and a shaft tip part 30 relatively rotatably secured to the shaft body part 20.

In the present embodiment, the film roll supporting device 10 is applied to a bag making and packaging machine 100. In the description below, after the schematic structure of the bag making and packaging machine 100 is described, the film roll supporting device 10 will be described in detail.

(2) Bag Making and Packaging Machine 100

Figure 3:
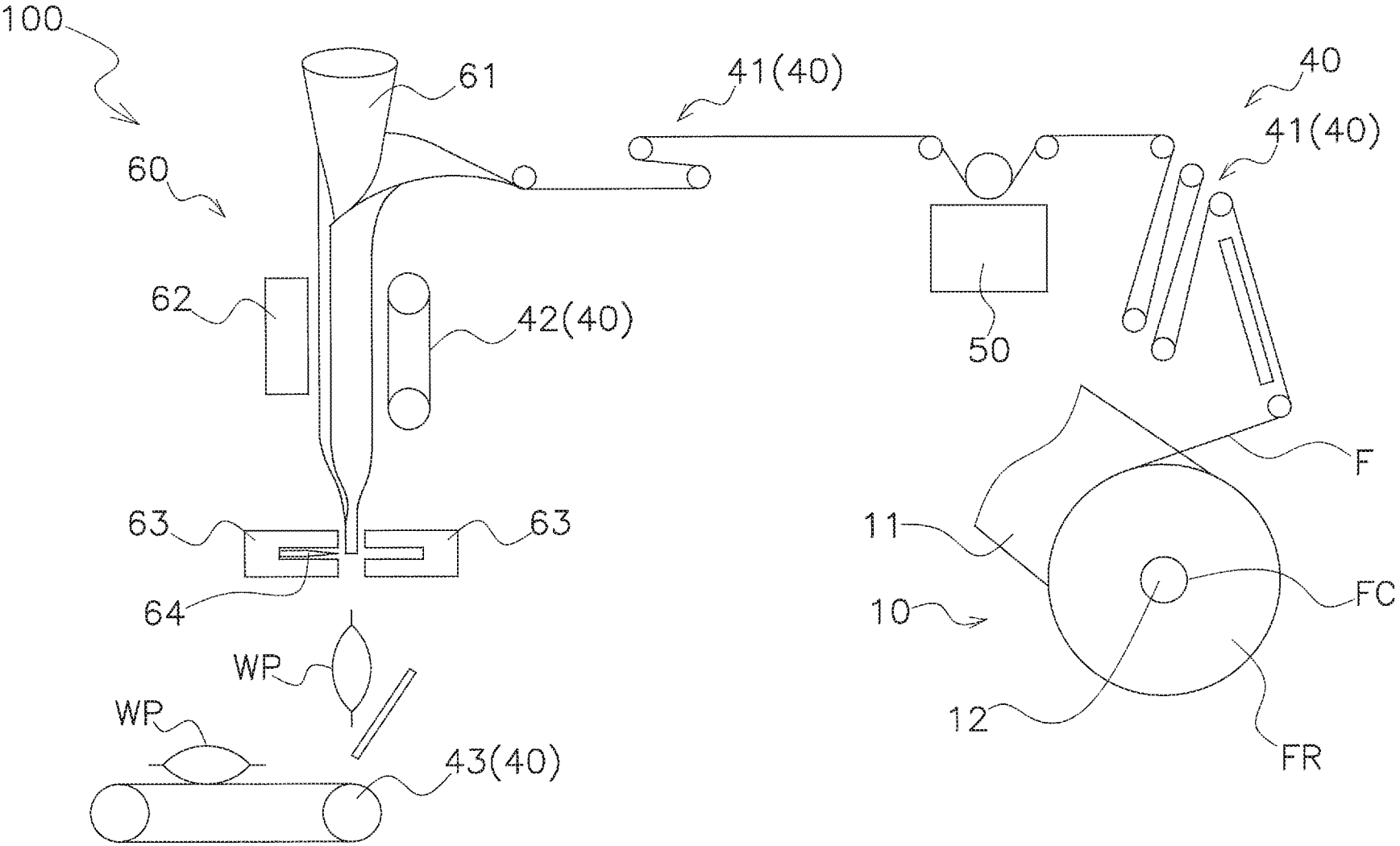
FIG. 3 is a schematic view of the structure of a bag making and packaging machine to which the film roll supporting device according to the embodiment of the present invention is applied.

FIG. 3 is a schematic view of the structure of the bag making and packaging machine 100 to which the film roll supporting device 10 according to one embodiment of the present invention is applied.

The bag making and packaging machine 100 is an apparatus which shapes the film F delivered from the film roll FR supported on the film roll supporting device 10, seals it at a predetermined position, fills it with articles, again seals it to make a bag, and then ejects it. The base part 11 of the film roll supporting device 10 is secured to a body frame 110 of the bag making and packaging machine 100 and the film roll supporting device 10 to be arranged on the bag making and packaging machine 100 (see FIGS. 4 and 5).

The bag making and packaging machine 100 primarily includes, not only the film roll supporting device 10, but also a conveyance part 40, a printing part 50, and a bag making part 60. The film roll supporting device 10 is positioned most upstream in a conveyance path of the film F in the bag making and packaging machine 100.

The conveyance part 40 includes a plurality of rollers 41, a pull-down belt 42, an ejection conveyor 43, and the like. The conveyance part 40 conveys the film F delivered from the film roll FR to downstream of the conveyance path (toward the bag making part 60 side).

The printing part 50 prints predetermined information such as a manufacturing date at a predetermined position in the film F which is being conveyed.

The bag making part 60 includes a former 61, a longitudinal sealing part 62, transverse sealing parts 63, a cutting part 64, and the like. The former 61 winds the film F conveyed in a planar shape and make two longitudinal sides of the film F to be overlap. The longitudinal sealing part 62 seals the two longitudinal sides of the film F overlapped by the former 61. The transverse sealing parts 63 transversely seal the film F, which has passed the longitudinal sealing part 62 and shaped in tubular form, at a predetermined position. After the film F thus sealed has been filled with one pack of articles via the former 61, the transverse sealing parts 63 seal an opening of the film filled with the articles.

The cutting part 64 cuts the film F, which has undergone the process as described above at the transverse sealing parts 63, at a predetermined position.

A product WP thus filled with the articles and made into a bag during the passage through the bag making part 60 is ejected out of the bag making and packaging machine 100 by the ejection conveyor 43 of the conveyance part 40.

(3) Detail of Film Roll Supporting Device 10

Figure 4:
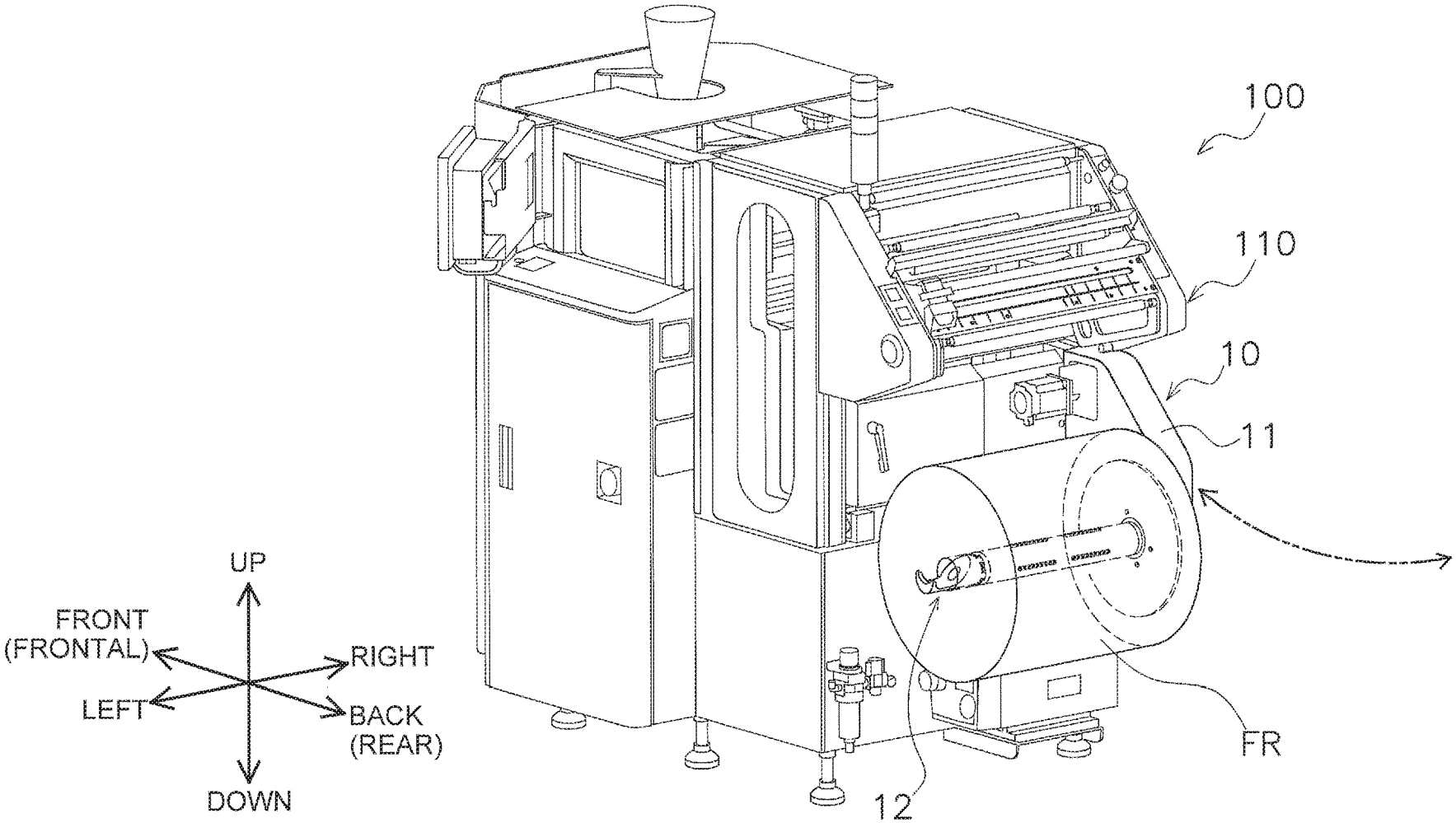
FIG. 4 is a perspective view of the film roll supporting device applied to the bag making and packaging machine.
Figure 5:
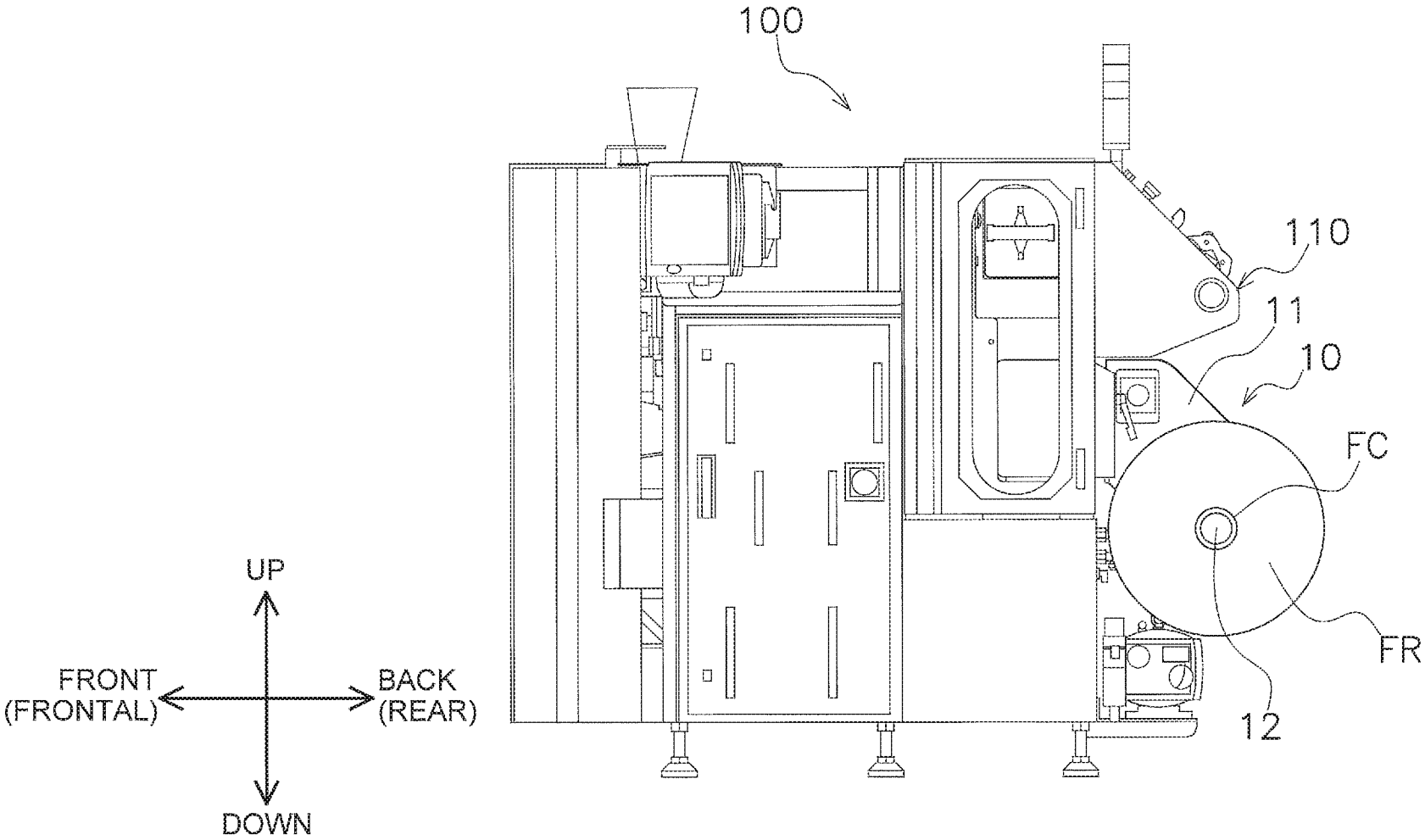
FIG. 5 is a left side view of the film roll supporting device applied to the bag making and packaging machine.
Figure 6:
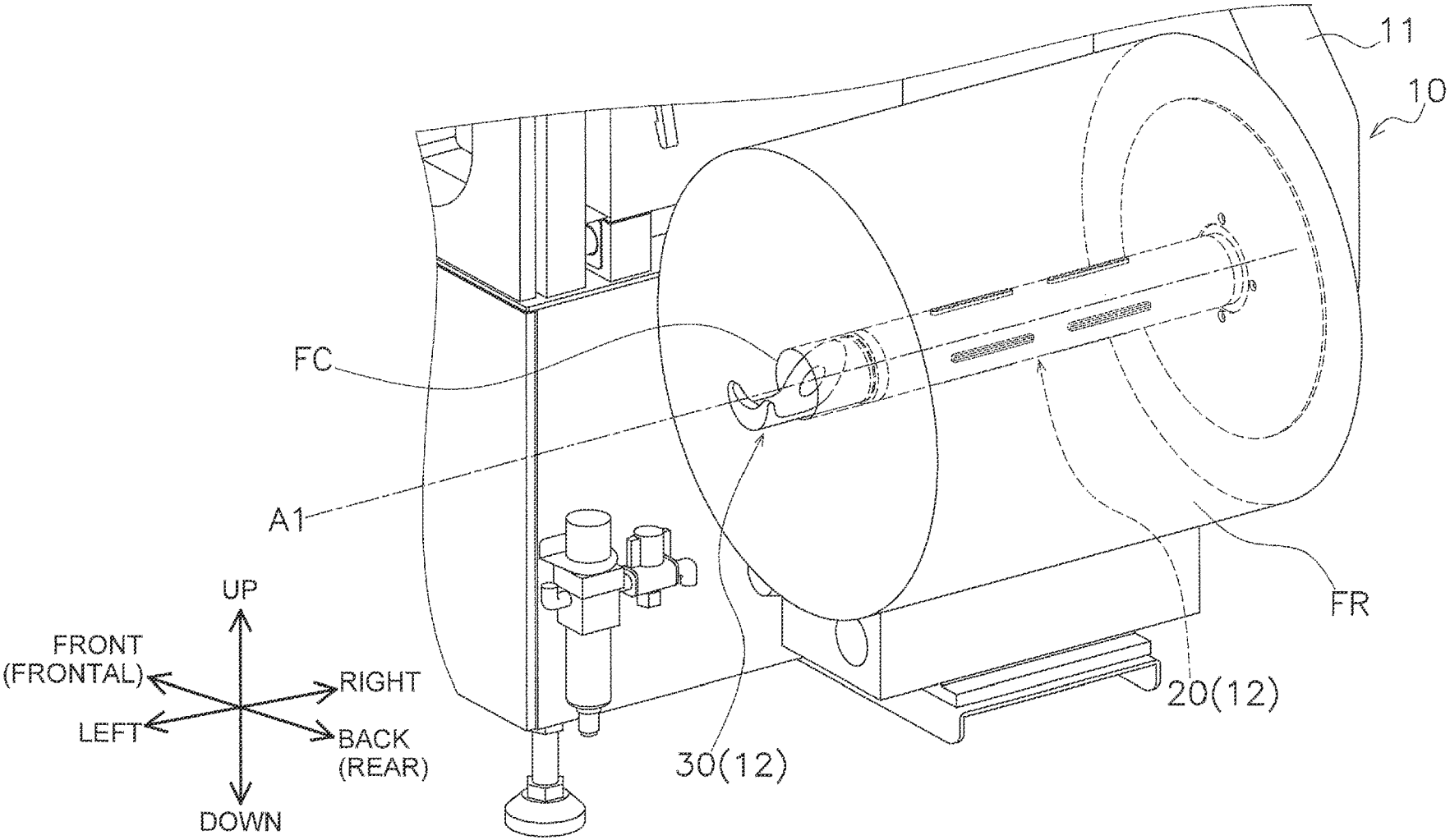
FIG. 6 is an enlarged view of the film roll supporting device in FIG. 4.
Figure 7:
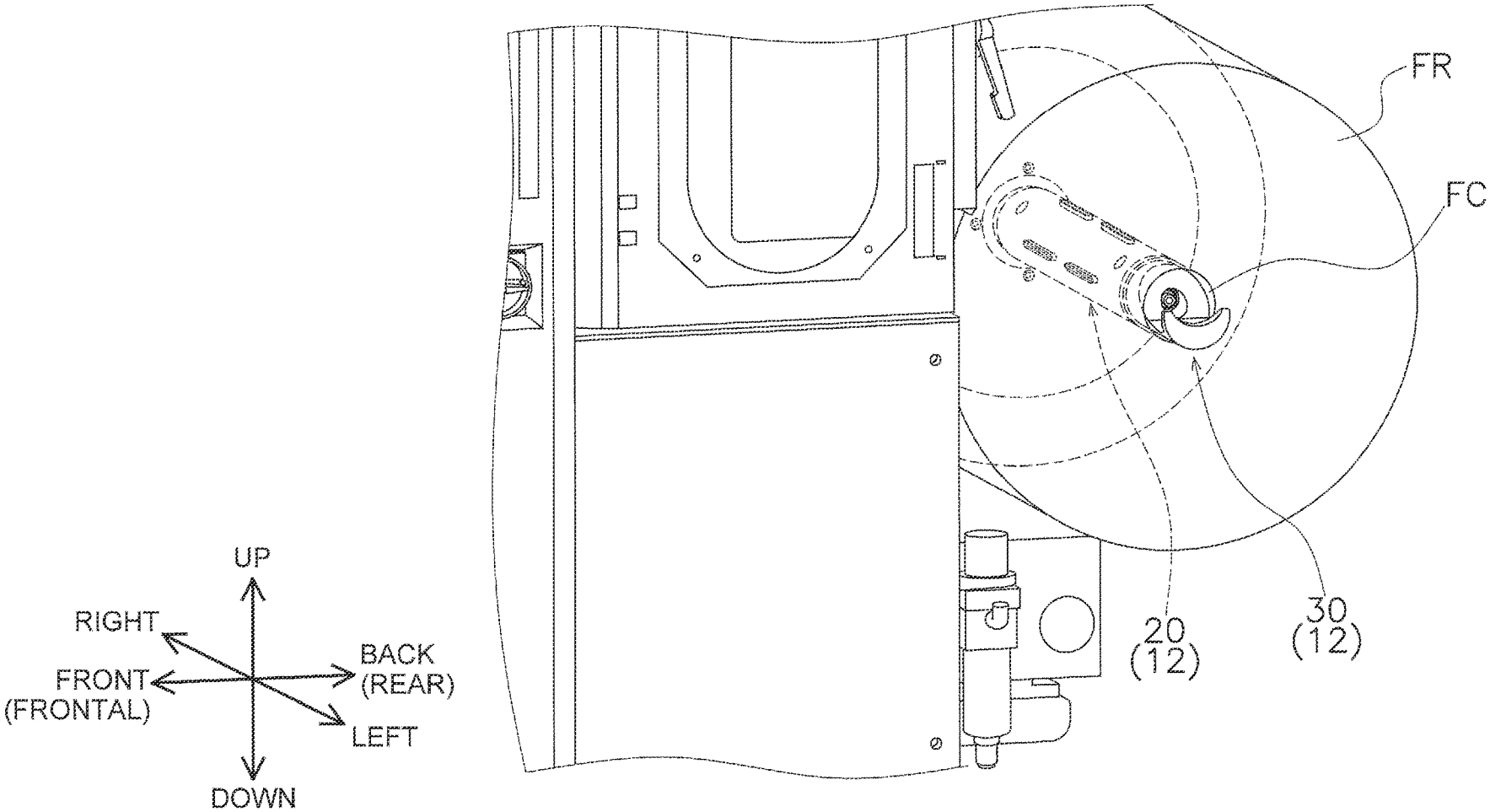
FIG. 7 is a perspective view of FIG. 6 as seen at a different angle.

FIG. 4 is a perspective view of the film roll supporting device 10 applied to the bag making and packaging machine 100. FIG. 5 is a left side view of the film roll supporting device 10 applied to the bag making and packaging machine 100. FIG. 6 is an enlarged view of the film roll supporting device 10 in FIG. 4. FIG. 7 is a perspective view of FIG. 6 as seen at a different angle. In FIGS. 4 to 7, the film roll FR is mounted on the film roll supporting device 10.

As described above, the film roll supporting device 10 includes the base part 11 and the shaft 12.

(3-1) Base Part 11

Figure 8:
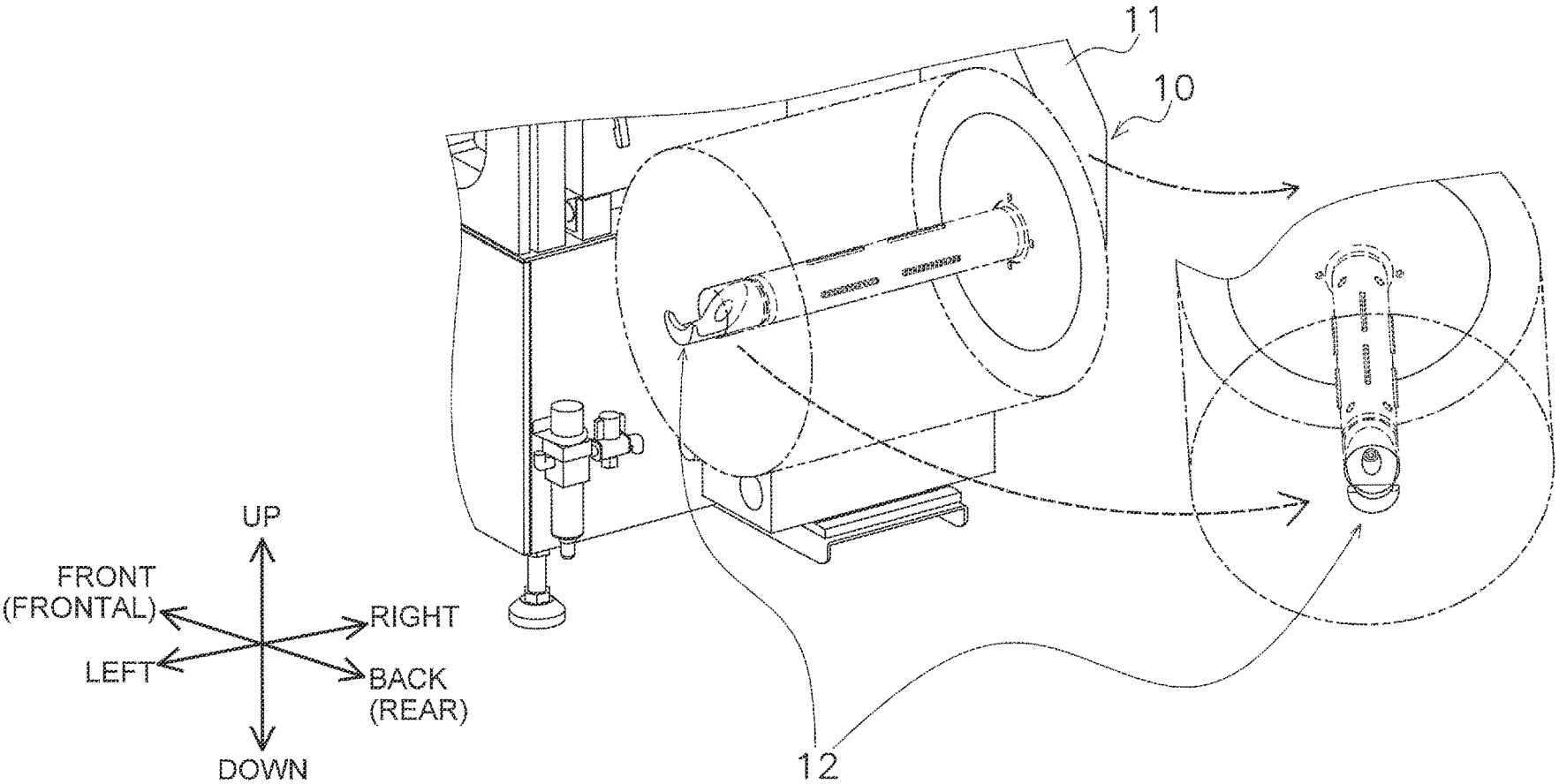
FIG. 8 schematically shows how the shaft pivots in synchronization with the base part when the base part pivots.

The base part 11 is secured to the body frame 110 of the bag making and packaging machine 100 such that the shaft 12 and the output shaft of the shaft motor 13 extend in a horizontal direction (more specifically toward left from right). Specifically, the base part 11 is secured to the body frame 110 pivotally around the vertical line as its axis in a predetermined range as indicated by the double-dashed line arrow in FIG. 4. The shaft 12 and the shaft motor 13 secured to the base part 11 also pivot along with the rotation of the base part 11. According to this, during the replacement of the film roll FR, an operator is able to pivot the base part 11 in a predetermined range to move the shaft 12 to a position at which the mounting of the film roll FR is readily performed as shown in FIG. 8. FIG. 8 schematically shows how the shaft 12 pivots in synchronization with the base part 11 when the base part 11 pivots (in FIG. 8, the dashed line arrow indicates the pivot direction of the shaft 12).

(3-2) Shaft 12

Figure 9:
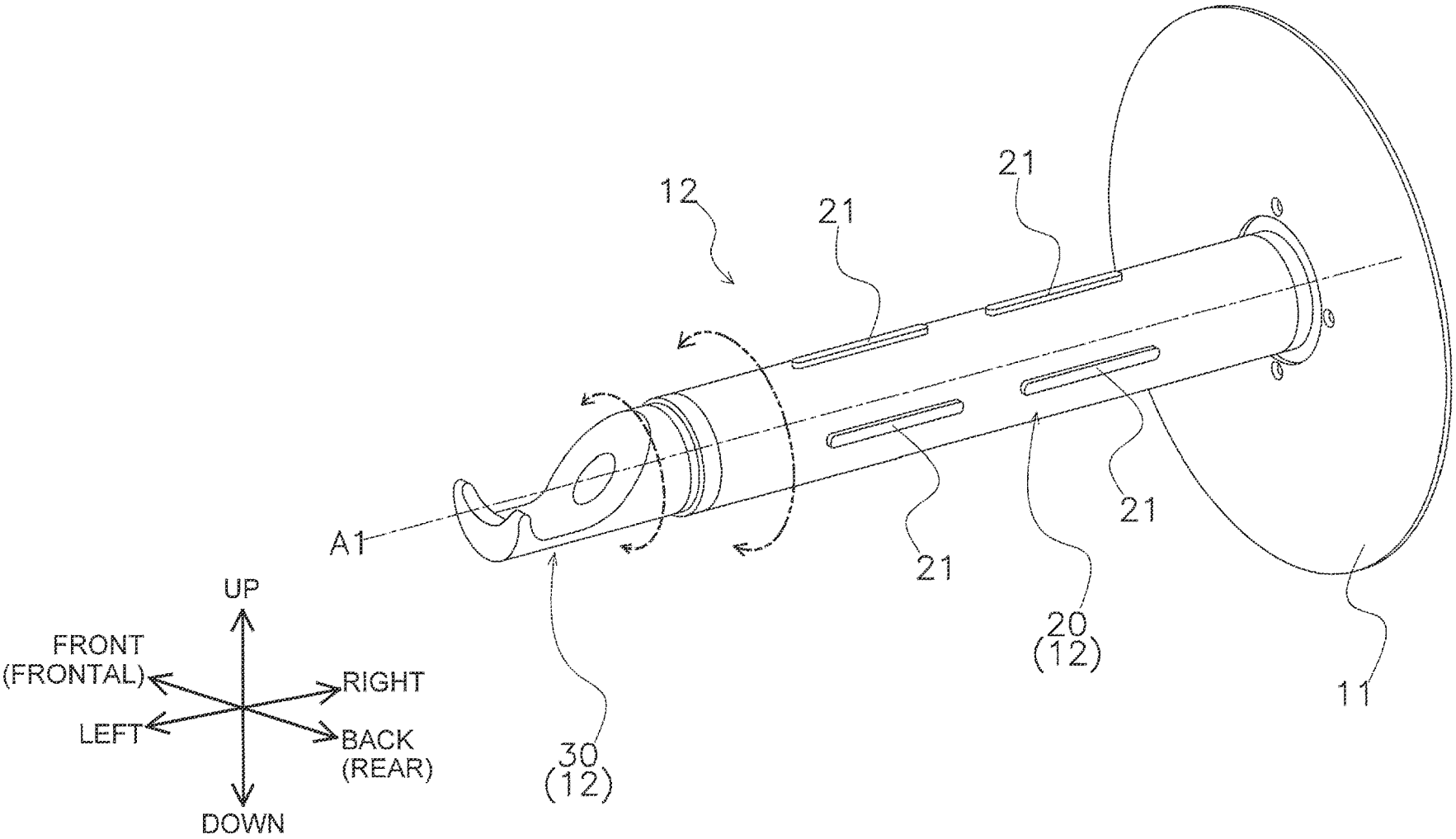
FIG. 9 is a perspective view of the shaft.

FIG. 9 is a perspective view of the shaft 12 (in FIG. 9, the double-dashed line arrow indicates the rotation direction of the shaft body part 20 and the dashed line arrow indicates the rotation direction of the shaft tip part 30).

The shaft 12 extends in the horizontal direction (the left direction) from the base part 11. That is to say, an axis A1 of the shaft 12 extends in the left-and-right direction. The film roll FR is inserted onto the shaft 12 via the central hole H1 in order for the film roll FR to be mounted thereon. In FIGS. 4 to 7, a tip of the shaft 12 (a portion of the shaft tip part 30) extends through the central hole H1 of the film roll and is exposed therefrom. As described above, the shaft 12 primarily includes the shaft body part 20 and the shaft tip part 30. The shaft 12 also includes a projection part 70 in the shaft tip part 30.

(3-2-1) Shaft Body Part 20

The shaft body part 20 occupies most of the shaft 12 and assumes a substantially cylindrical or columnar shape as shown in FIG. 9. The shaft body part 20 extends in the left direction from the base part 11. The shaft body part 20 is screwed to the base part 11 rotatably around the axis A1 (see the double-dashed line arrow in FIG. 9). The shaft body part 20 is connected to the output shaft of the shaft motor 13 to rotate in synchronization with the driving of the shaft motor 13. A portion or the entire of the shaft body part 20 is housed in the central hole H1 in the state in which the film roll FR is mounted thereon. In this state, the shaft body part 20 abuts the core FC to support the mounted film roll FR on the portion thereof abutting it. The shaft body part 20 is provided with a plurality of catching portions 21 which is configured to be convex and to catch the core FC when the film roll FR is mounted thereon.

(3-2-2) Shaft Tip Part 30

Figure 10:
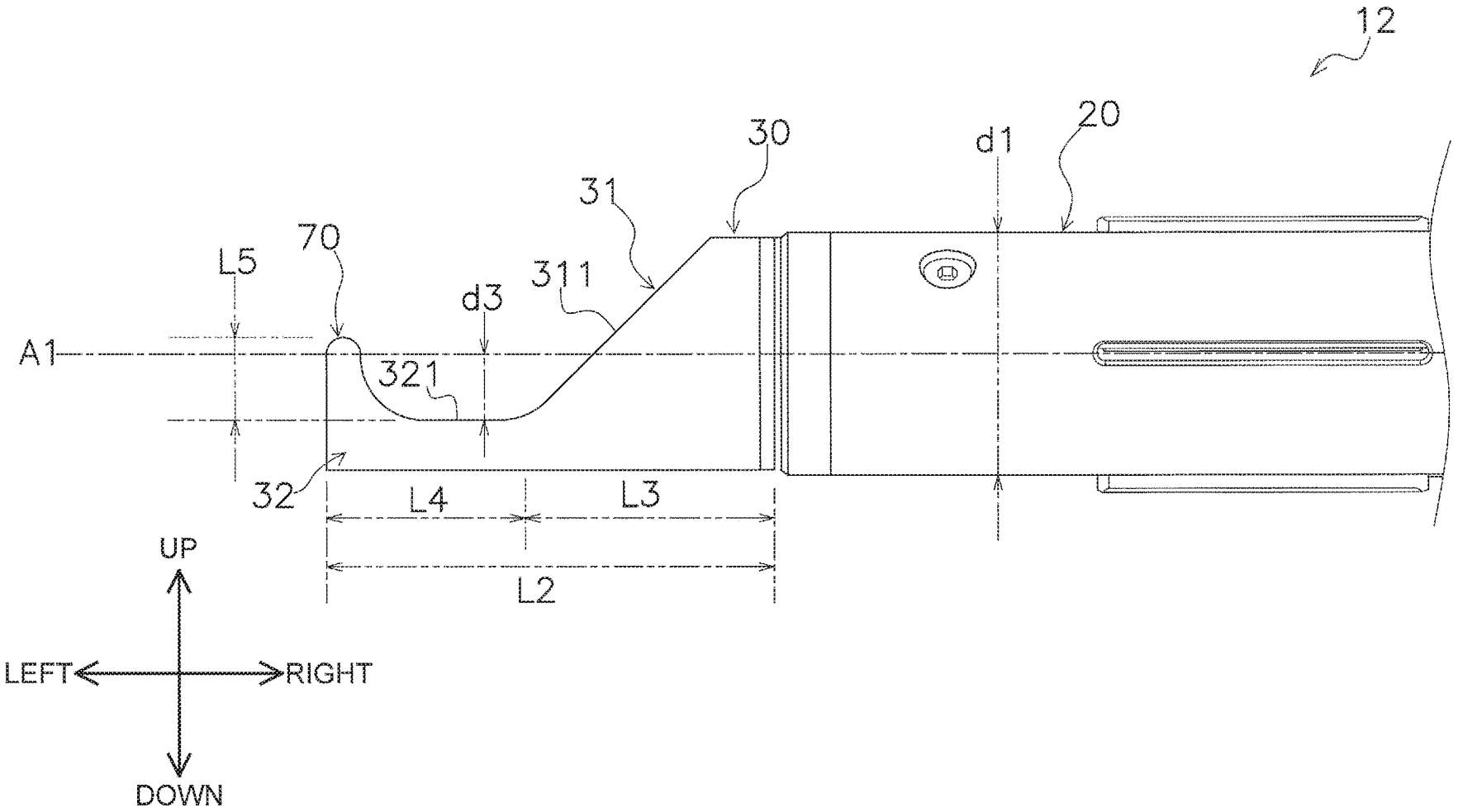
FIG. 10 is an enlarged view of a shaft tip part and a projection part in the back view.
Figure 11:
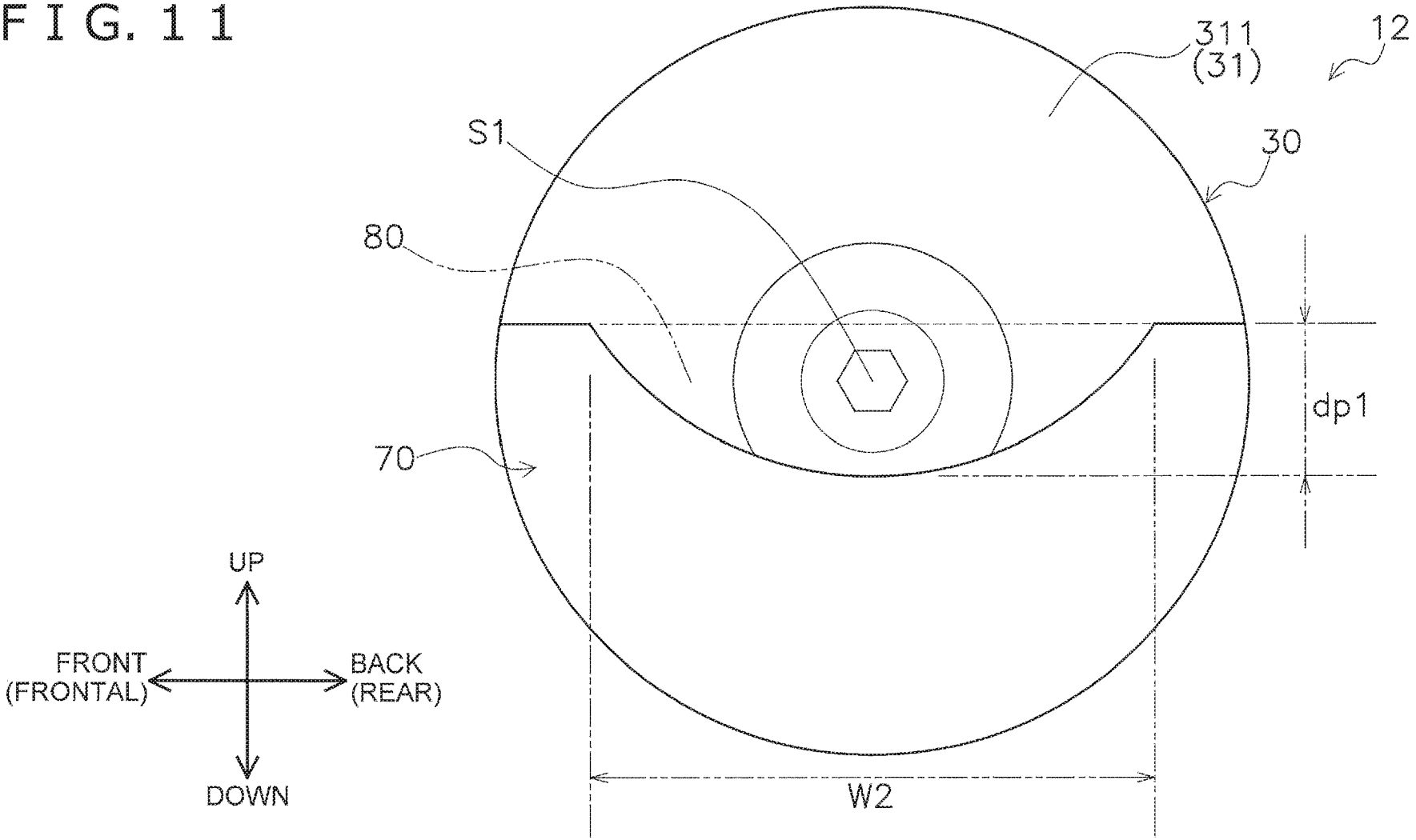
FIG. 11 is an enlarged view of the shaft tip part and the projection part in the left side view.

FIG. 10 is an enlarged view of the shaft tip part 30 and the projection part 70 in the back view. FIG. 11 is an enlarged view of the shaft tip part 30 and the projection part 70 in the left side view.

The shaft tip part 30 assumes a substantially L shape in the front view (as viewed in a direction perpendicularly intersecting the axis A1) and has a shape upwardly and downwardly asymmetrical about the axis A1. The shaft tip part 30 also assumes a substantially U shape or a substantially crescent shape in the left side view (as viewed in the axis A1 direction) and has a shape upwardly and downwardly asymmetrical.

The shaft tip part 30 is joined to the left side end of the shaft body part 20. The shaft tip part 30 is screwed to the shaft body part 20 relatively rotatably around the axis A1 (see the dashed line arrow in FIG. 9).

The shaft tip part 30 extends in the left direction from the left side end of the shaft body part 20. That is to say, the shaft tip part 30 extends in the axis A1 direction from the end of the shaft body part 20 on the side from which the central hole H1 of the film roll FR is introduced.

The shaft tip part 30 has a length L2 in the axis A1 direction (here, the horizontal direction) longer than a length L5 of the projection part 70 in the longitudinal direction (here, the vertical direction), which will be described later. In the present embodiment, the length L2 is five times as long as or longer than the length L5.

The center of gravity of the shaft tip part 30 is positioned such that a tip of the projection part 70 upwardly faces and a cutout 80 (which will be described later) formed in the projection part 70 is recessed downwardly when the shaft tip part 30 is in a stationary state (in a state in which it does not rotate). According to this, the shaft tip part 30 keeps its orientation as shown in FIGS. 10 and 11 when it is stationary.

The shaft tip part 30 includes a joining portion 31 joined to the shaft body part 20 and an extending portion 32 connected to the projection part 70. It should be noted that the joining portion 31 is configured integrally with the extending portion 32. A clear boundary between the joining portion 31 and the extending portion 32 is not present. However, for convenience of description, a portion having a length L3 in the axis A1 direction is referred to as the joining portion 31, and a portion having a length L4 in the axis A1 direction is referred to as the extending portion 32.

The joining portion 31 is a portion joined to the shaft body part 20. A screw hole (not shown) is formed in the joining portion 31. The joining portion 31 is screwed to the shaft body part 20 via this screw hole with a screw 51. The joining portion 31 has an inclined surface and assumes a substantially triangle or trapezoid in the front view or in the back view. The inclined surface constitutes a guide surface 311 for the film roll FR.

The guide surface 311 abuts the film roll FR that is in movement to guide the film roll FR to the shaft body part 20 during the mounting of the film roll FR. Specifically, the guide surface 311 downwardly inclines and extends toward a portion connected to the extending portion 32 in the stationary state (in the state in which it does not rotate). In other words, the guide surface 311 downwardly inclines and extends toward the projection part 70 direction.

The extending portion 32 assumes a plate shape. The extending portion 32 extends in the left direction (i.e., in the direction opposite to the shaft body part 20) from the left side end (i.e., the end opposed the end on the shaft body part 20 side) of the joining portion 31. In the present embodiment, the extending portion 32 has the length L4 in the axis A1 direction (the horizontal direction) longer than the length L5 of the projection part 70 in the longitudinal direction. Specifically, the length L4 is twice as long as or longer than the length L5. The extending portion 32 has an upper surface 321 substantially horizontally extending at a height position lower than the axis A1 (i.e., the central axis of the shaft body part 20). A distance d3 between the axis A1 and the upper surface 321 (see FIG. 10) is set to a distance which is able to form a space between the core FC and the upper surface 321. This space is able to accommodate a hand (including fingers) holding the core FC when the core FC of the film roll FR is placed on the tip of the projection part 70. In the present embodiment, the distance d3 is set to 20 mm. According to this, when the film roll FR is provisionally placed on the shaft tip part 30, after portion of the film roll FR being inserted onto the shaft tip part 30, until being placed on the projection part 70, a clearance CL2 (see FIG. 14) is adequately largely left to function as a space for accommodating the holding hand (including fingers) on the introduction side of the film roll FR.

(3-2-3) Projection Part 70

The projection part 70 is a portion abutting from below to the core FC of the film roll FR provisionally placed on the shaft tip part 30 when the mounting of the film roll FR is performed. The projection part 70 extends in the up direction (i.e., a direction intersecting the axis A1 direction of the shaft body part 20) from the extending portion 32 (i.e., the vicinity of a tip of the shaft tip part 30). The projection part 70 is extruded or the like and thus configured integrally with the extending portion 32 (the shaft tip part 30). Therefore, the projection part 70 rotates together with the shaft tip part 30. That is to say, the projection part 70 is rotatable around the axis A1 direction of the shaft body part 20.

It should be noted that a clear boundary between the projection part 70 and the extending portion 32 is not present. However, for convenience of description, a portion having the length L5 in the vertical direction (i.e., the direction in which the projection part 70 extends) is referred to as the projection part 70 (see FIG. 10).

One substantially semicircle cutout 80 is formed in the projection part 70 in the left side view (see FIG. 11). The cutout 80 is recessed in the down direction (a direction intersecting the axis A1 direction of the shaft body part 20) from the tip (i.e., an upper end) of the projection part 70. In FIG. 11, the referential numeral W2 indicates a width of the cutout 80, and the referential numeral dp1 indicates a depth of the cutout 80. Since such a cutout 80 is formed, the projection part 70 assumes a substantially crescent shape in the left side view.

(4) Primary Features of Film Roll Supporting Device 10

The film roll supporting device 10 is excellent in the operability in the mounting operation of the film roll FR primarily for the reasons as described below.

(4-1)

In the film roll supporting device 10, the mounting operation of the film roll FR is usually performed as follows: the core FC of the film roll FR is held by both hands; the film roll FR is inserted onto the tip of the shaft 12 via the central hole H1 and slid to an installation position.

However, due to the weight of the film roll FR, some operators performing the mounting operation have difficulty in directly sliding the film roll FR to the installation position after inserting it onto the tip of the shaft 12. In such a case, it is desirable to provisionally place the film roll FR on the shaft tip part 30 temporarily and to relieve a support force of the holding hand on the introduction side after the portion of the film roll FR is inserted onto the tip of the shaft 12 and before the entire of the film roll FR is slid to the installation position.

Figure 12:
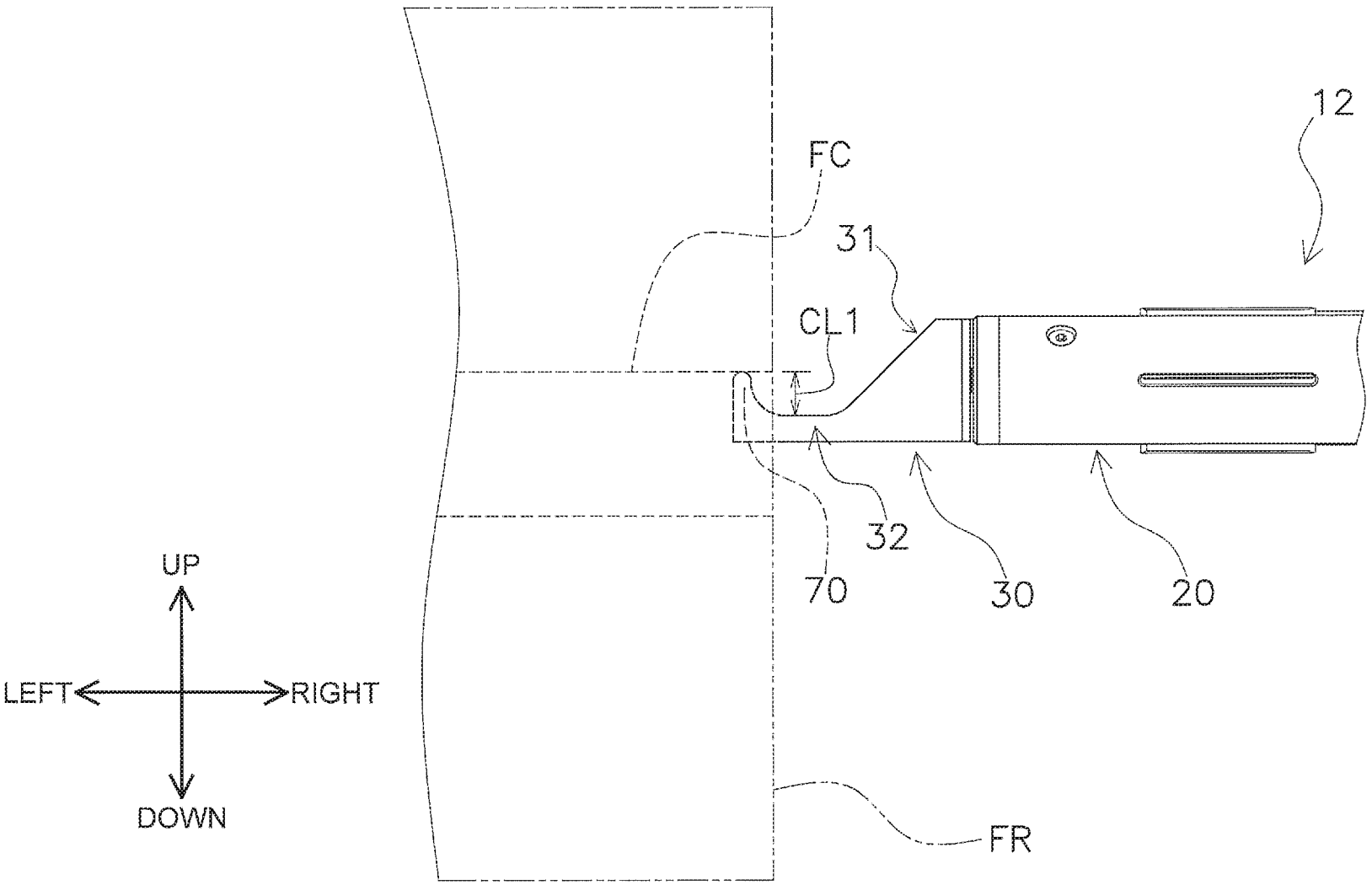
FIG. 12 schematically shows how the film roll is provisionally placed on the shaft tip part during the mounting operation of the film roll.

Since, in the film roll supporting device 10, the shaft tip part 30 is provided with the projection part 70 extending in the up direction (i.e., in the direction opposite to the direction in which the gravity acts on the film roll FR), in the case in which the film roll FR is placed on the tip of the projection part 70 after the film roll FR being inserted onto the tip of the shaft 12, a clearance CL1 equivalent to the length L5 is formed between the location where the core FC abuts the projection part 70 and the upper surface 321 of the shaft tip part 30 (the extending portion 32) as shown in FIG. 12.

Consequently, when the film roll FR is placed on the tip of the projection part 70, the clearance CL1 functions as a space for accommodating the holding hand (including fingers) on the introduction side of the film roll FR. According to this, it is easy to provisionally place the film roll FR on the shaft tip part 30. Accordingly, it is excellent in the operability in the mounting operation of the film roll FR.

Figure 13:
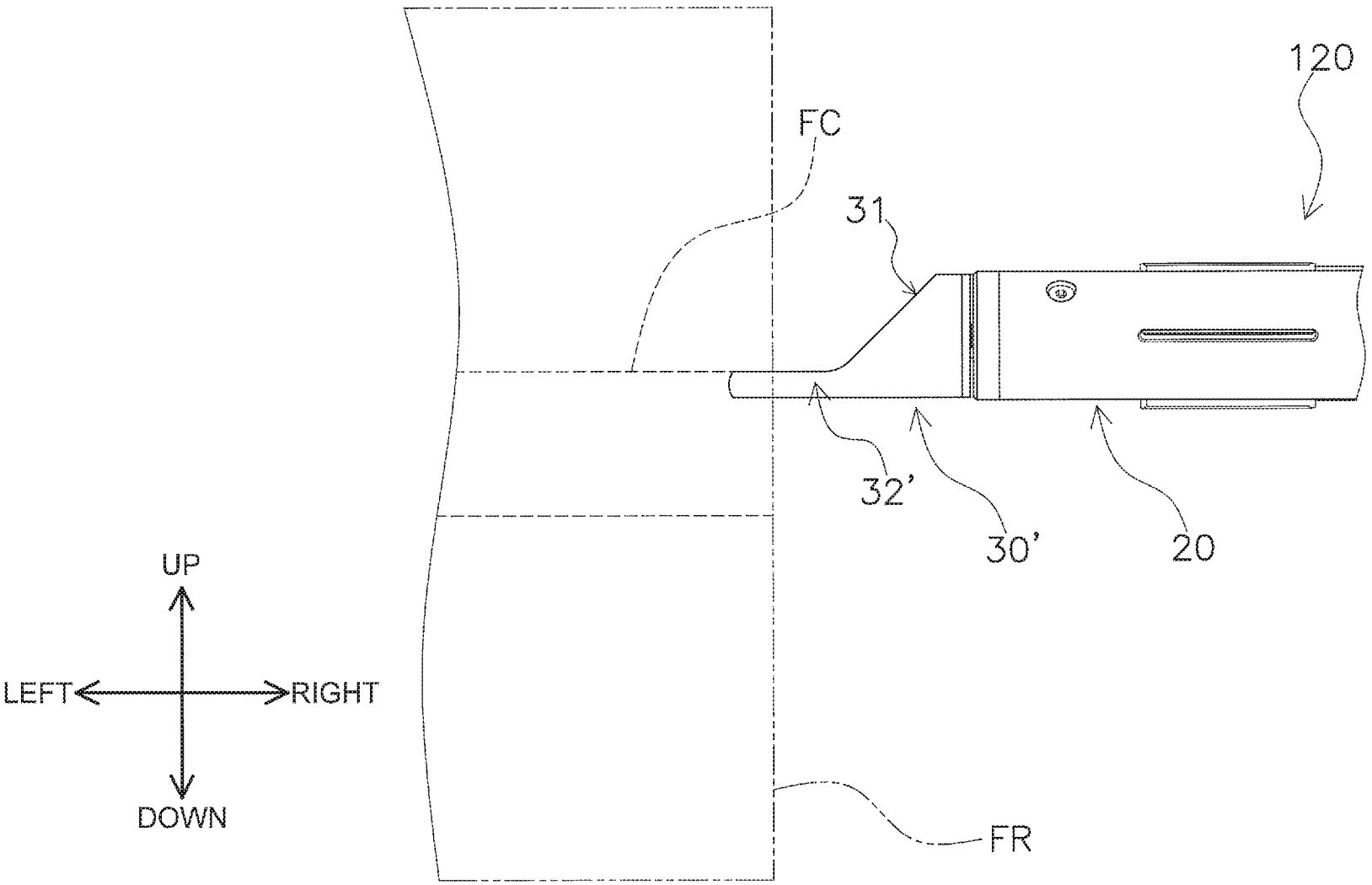
FIG. 13 schematically shows how the film roll is provisionally placed on the shaft tip part without the projection part.

In contrast to this, as shown in FIG. 13, in the case in which the film roll FR is placed on a shaft tip part 30' of a shaft 120 without the projection part 70, since the core FC and the shaft tip part 30' (the extending portion 32') abut each other, a clearance for accommodating a holding hand (including fingers) on the introduction side of the film roll FR is not formed. Therefore, when the film roll FR is provisionally placed, the holding hand on the introduction side needs to release the film roll FR before the film roll FR is placed on the shaft tip part 30; however, such operation is not easy. Consequently, it is likely that the film roll FR may not precisely be placed on the shaft tip part 30' and thus displaced and fall from a tip of the shaft tip part 30' (in the direction opposite to the installation position).

Thus, the film roll supporting device 10 is excellent in the operability in the mounting operation of the film roll FR compared to the shaft 120 without the projection part 70.

(4-2)

As shown in FIG. 10, in the film roll supporting device 10, the shaft tip part 30 (the extending portion 32) has the upper surface 321 substantially horizontally extending at the height position lower than the axis A1 (i.e., the central axis of the shaft body part 20). The distance d3 is left between the axis A1 and the upper surface 321, and forms the space between the core FC and the upper surface 321 being able to accommodate the hand (including fingers) holding the core FC when the core FC of the film roll FR is placed on the tip of the projection part 70.

According to this, during the mounting operation of the film roll FR, when the film roll FR is provisionally placed on the shaft tip part 30, after portion of the film roll FR being inserted onto the shaft tip part 30, until being placed on the projection part 70, the space for accommodating the holding hand (including fingers) on the introduction side of the film roll FR is left. Consequently, it is simple to place the portion of the film roll FR on the projection part 70 after it is inserted onto the shaft tip part 30. That is to say, it is easy to provisionally place the film roll FR on the shaft tip part 30. Accordingly, it is excellent in the operability in the mounting operation of the film roll FR.

Figure 15:
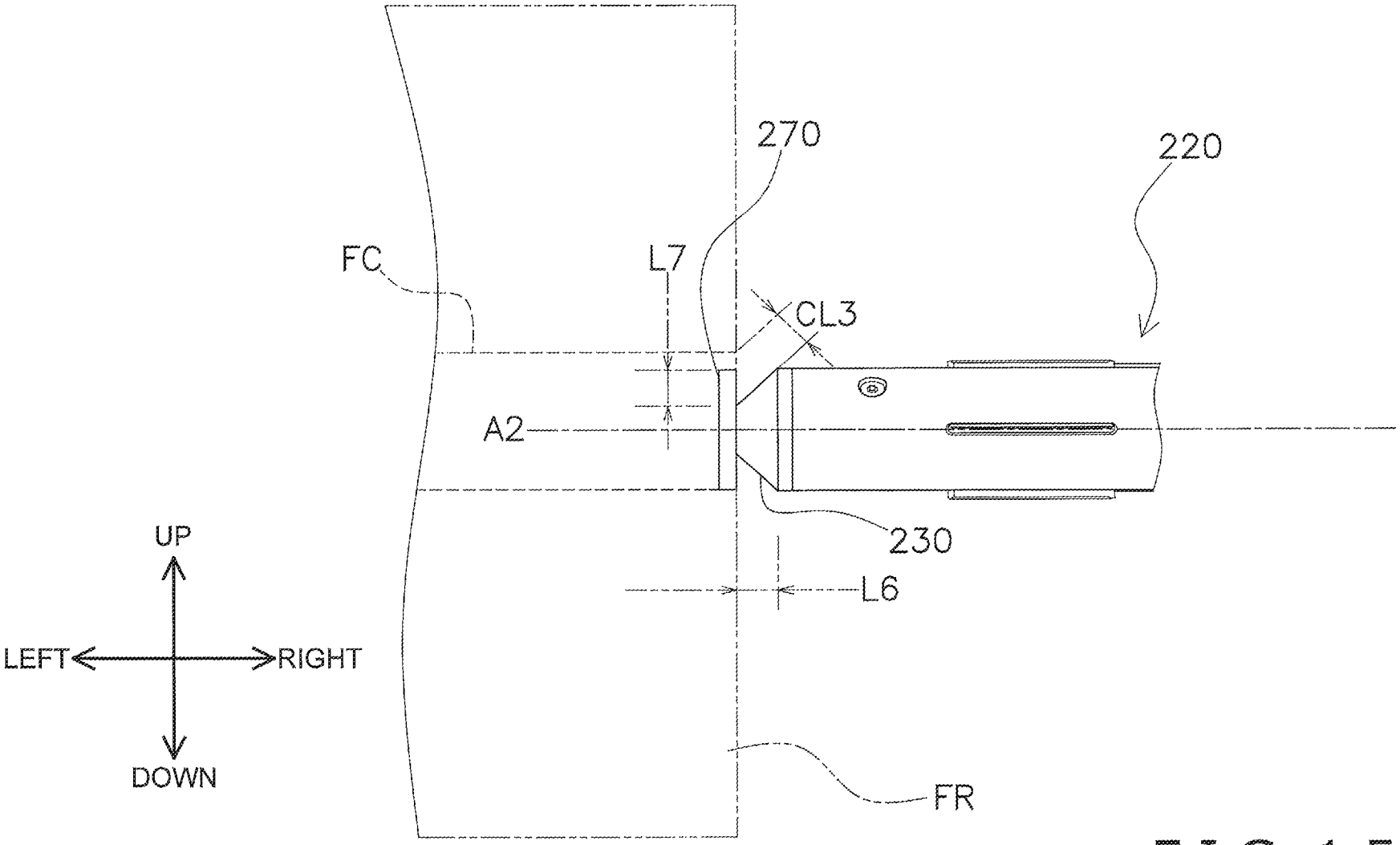
FIG. 15 PRIOR ART
FIG. 15 schematically shows a state when the portion of the film roll is inserted onto a conventional shaft tip part.
Figure 16:
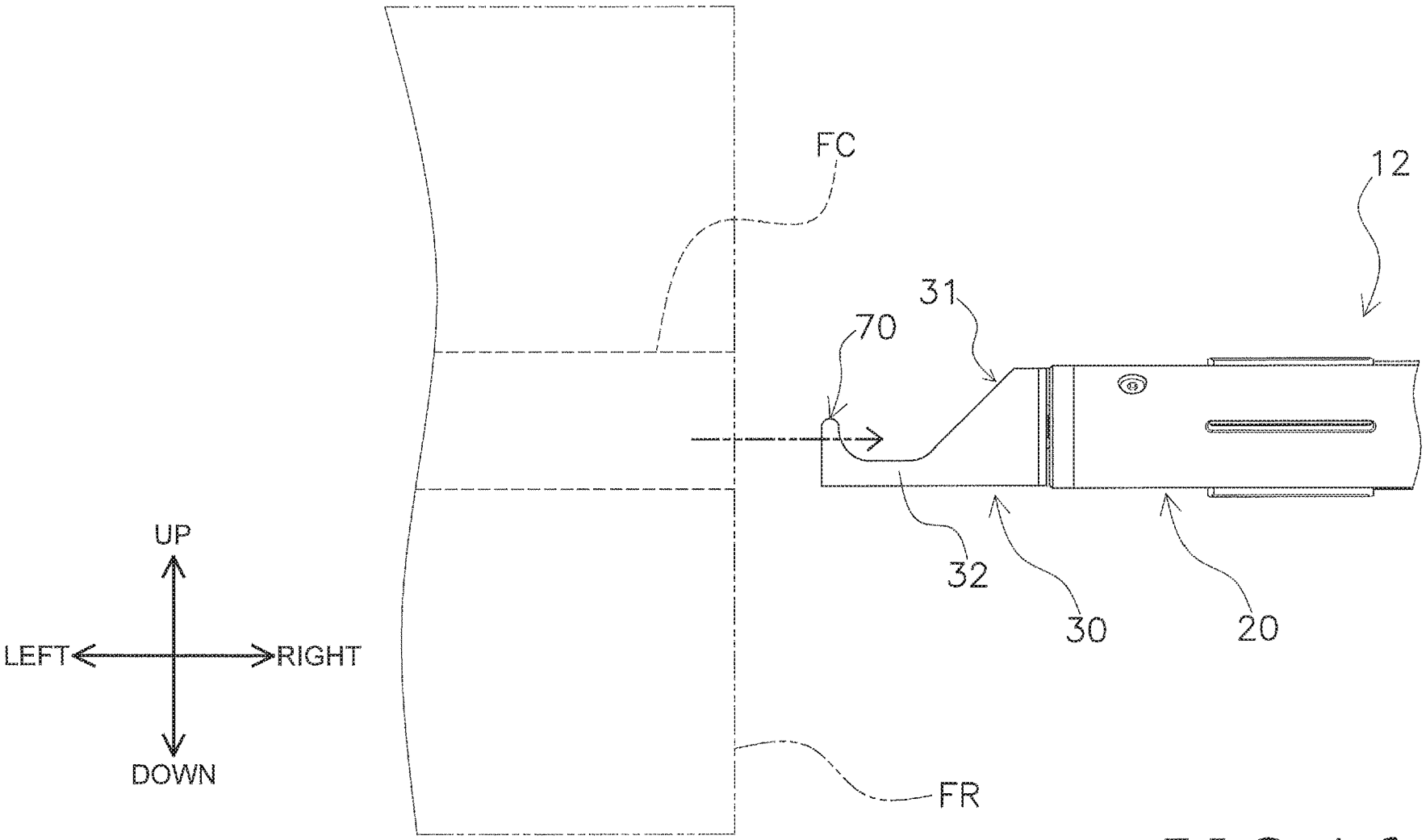
FIG. 16 schematically shows a movement path for a hand holding the film roll on the introduction side when passing the projection part via the cutout while the film roll is inserted onto the shaft tip part.
Figure 17:
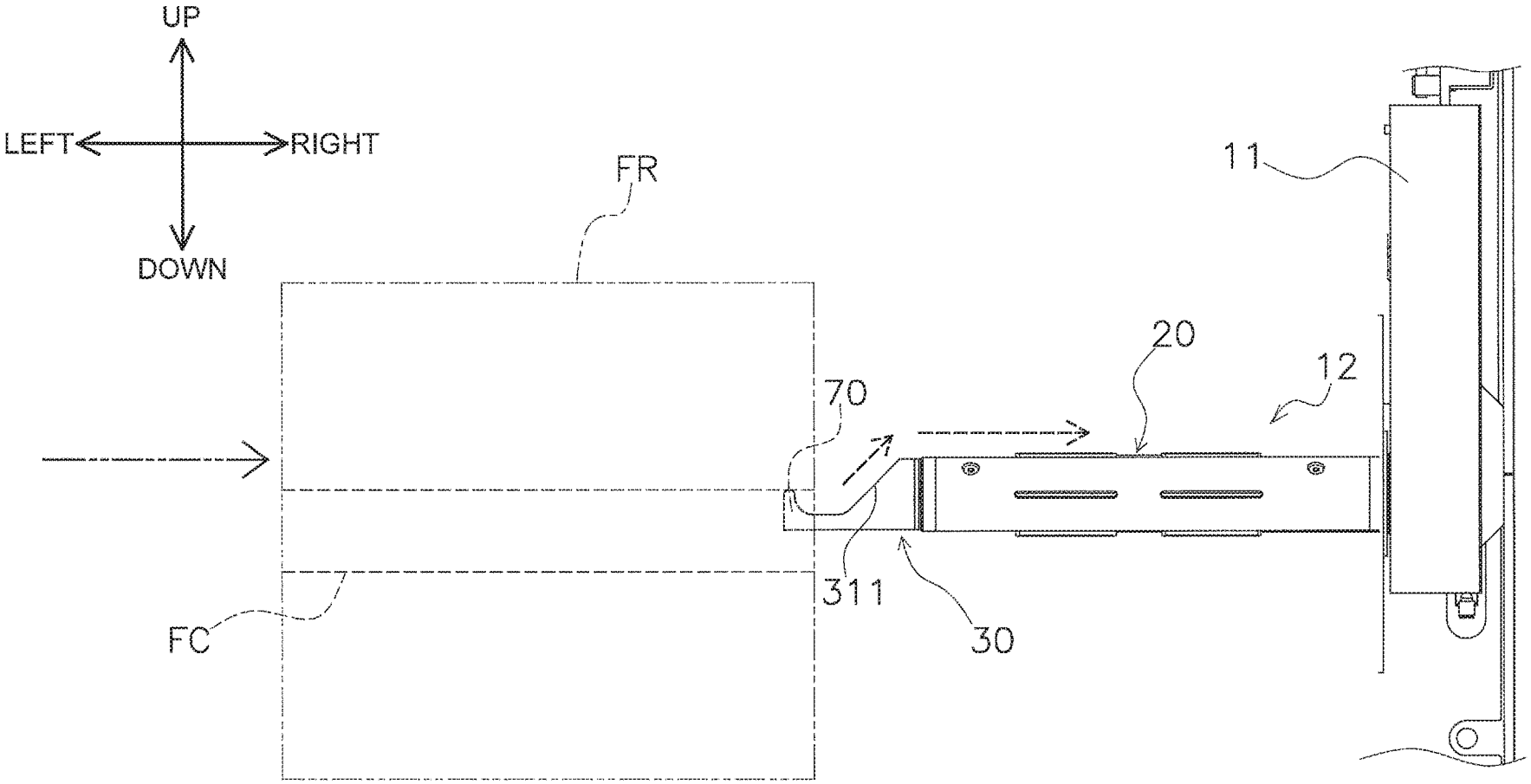
FIG. 17 schematically shows a movement path for the film roll guided by the guide surface when the portion of the film roll is provisionally placed on the shaft tip part and then the entire of the film roll is slid to an installation position.
Figure 18:
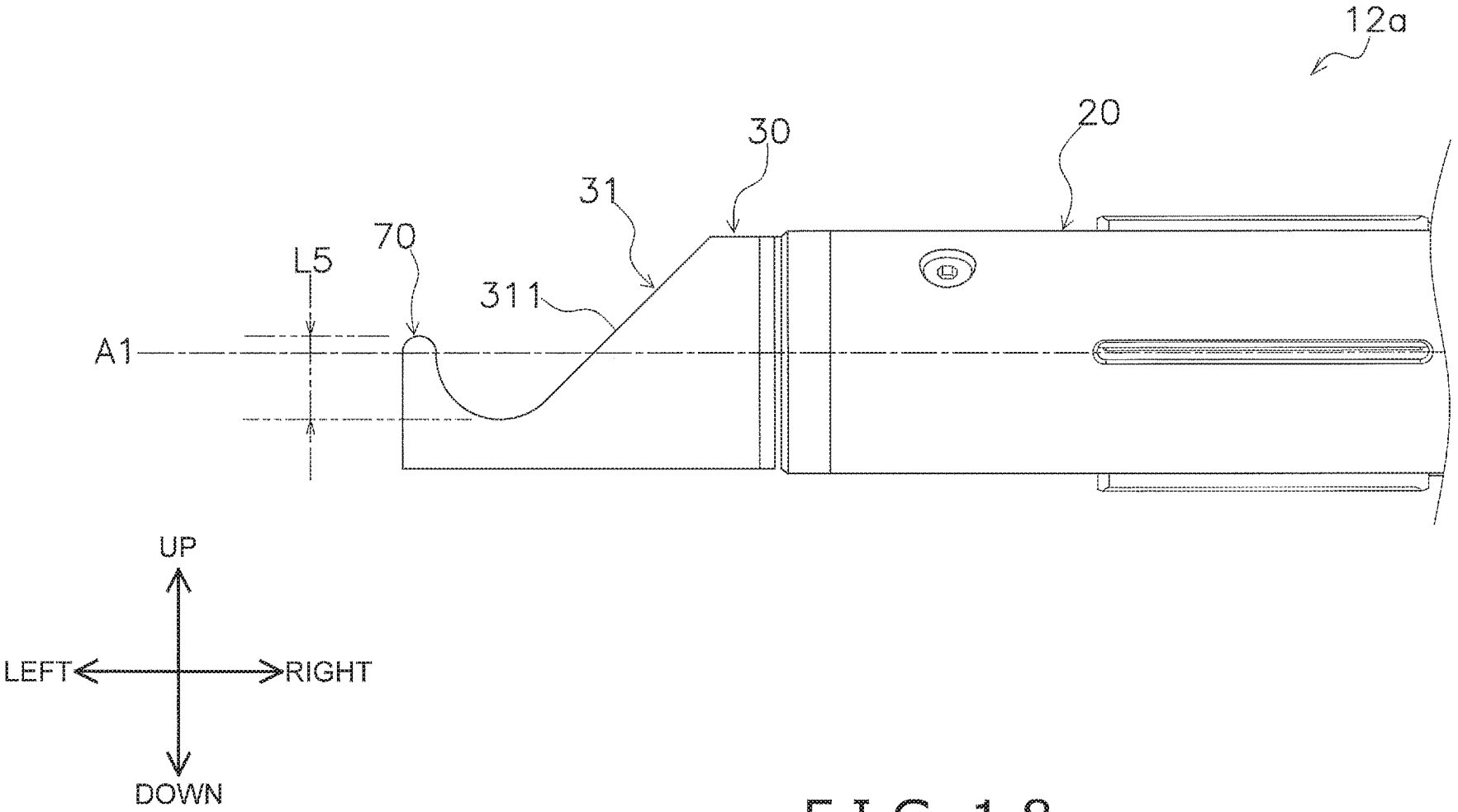
FIG. 18 is an enlarged view of the shaft tip part and the projection part according to modification F in the back view.

In contrast to this, as shown in FIG. 15, in a conventional shaft 220, a shaft tip part 230 has an upper surface portion higher than a central axis A2 of the shaft 220; thus, a space being able to accommodate a hand (including fingers) holding the core FC is not formed between the axis A2 and the upper surface portion of the shaft tip part 230. Thus, during the mounting operation of the film roll FR, when the film roll FR is provisionally placed on the shaft tip part 230, after portion of the film roll FR being inserted onto the shaft tip part 230, until being placed on the projection part 270, a space for accommodating a holding hand (including fingers) on the introduction side of the film roll FR is not left. Consequently, it is not simple to place the portion of the film roll FR on the projection part 270 (on the shaft tip part 230) after it is inserted onto the shaft tip part 230.

Thus, the film roll supporting device 10 is excellent in the operability in the mounting operation of the film roll FR compared to the case in which the film roll FR is mounted on the conventional shaft 220.

(4-3)

As shown in FIG. 10, in the film roll supporting device 10, the shaft tip part 30 has the length L2 in the axis A1 direction (the horizontal direction) longer than (five times as long as or longer than) the length L5 of the projection part 70 in the longitudinal direction (here, the vertical direction). In particular, in the film roll supporting device 10, the length L4 of the extending portion 32 in the axis A1 direction (the horizontal direction) is longer than (twice as long as or longer than) the length L5 of the projection part 70 in the longitudinal direction.

Figure 14:
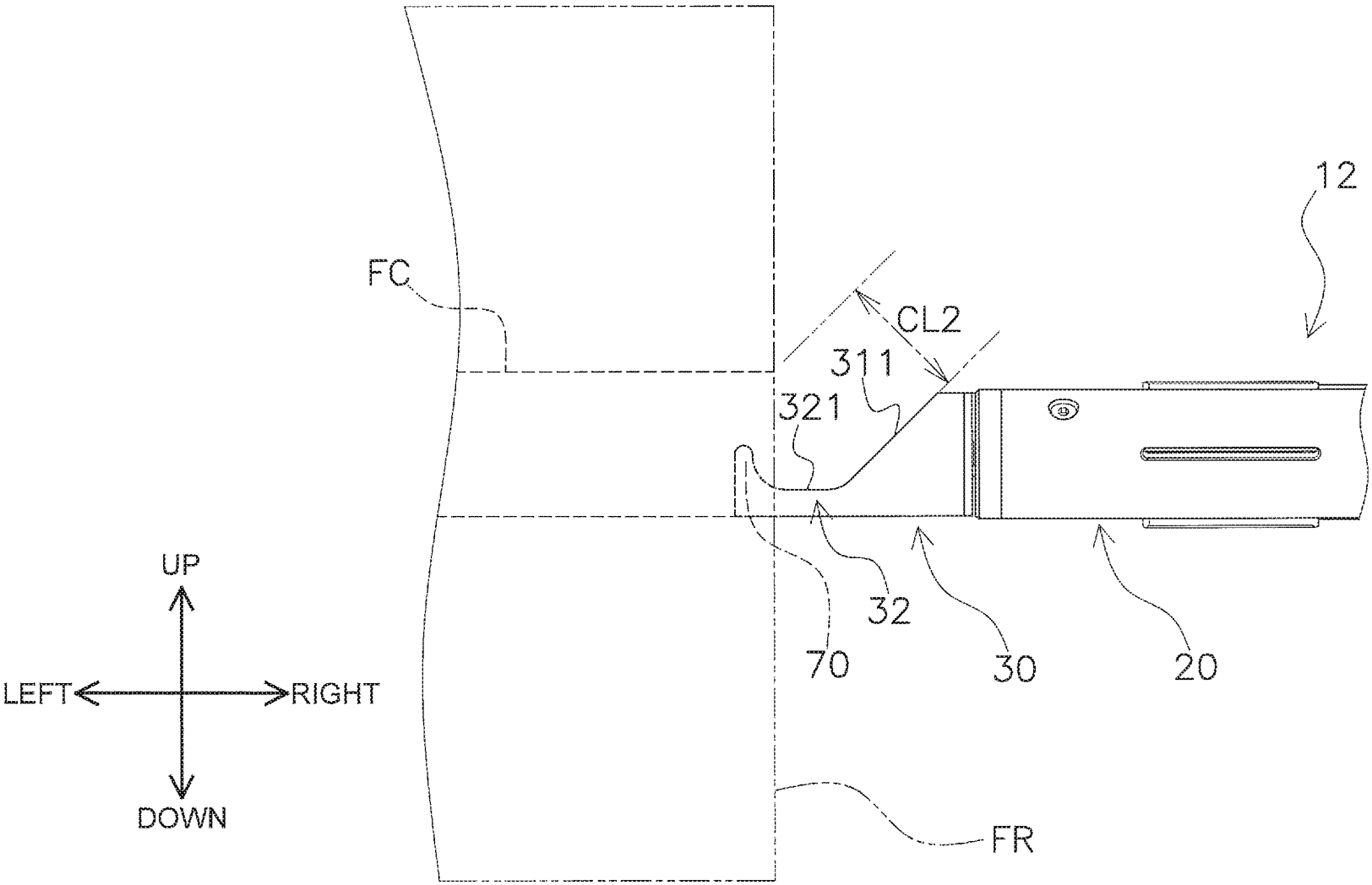
FIG. 14 schematically shows a state when a portion of the film roll is inserted onto the shaft tip part.

Thus, since the shaft tip part 30 (the extending portion 32) has the length in the axis A1 direction twice as long as or longer than the length L5 of the projection part 70 in the longitudinal direction, during the mounting operation of the film roll FR, when the film roll FR is provisionally placed on the shaft tip part 30, after portion of the film roll FR being inserted onto the shaft tip part 30, until being placed on the projection part 70, the clearance CL2 is adequately largely left to function as the space for accommodating the holding hand (including fingers) on the introduction side of the film roll FR as shown in FIG. 14. The clearance CL2 is a clearance formed between the location where the holding hand (including fingers) abuts the core FC and the upper surface 321 or the guide surface 311 of the shaft tip part 30 (the extending portion 32) when the portion of the film roll FR is inserted onto the shaft tip part 30.

Consequently, it is simple to place the portion of the film roll FR on the projection part 70 after it is inserted onto the shaft tip part 30. That is to say, it is easy to provisionally place the film roll FR on the shaft tip part 30. Accordingly, it is excellent in the operability in the mounting operation of the film roll FR.

In contrast to this, as shown in FIG. 15, in the conventional shaft 220 having the shaft tip part 230 and the projection part 270 and having a shape upwardly and downwardly symmetrical about the axis A2 in the back view (as viewed in the direction intersecting the axis A2), the shaft tip part 230 has a length L6 in the axis A2 direction (the horizontal direction) equal to or shorter than a length L7 of the projection part 270 in the longitudinal direction (here, the vertical direction), or substantially equal to the length L7. Therefore, after portion of the film roll FR being inserted onto the shaft tip part 230, until being placed on the projection part 270, a clearance CL3 is left; however, it is not adequately large to function as a space for accommodating the holding hand (including fingers) on the introduction side of the film roll FR as shown in FIG. 15. The clearance CL3 is a clearance formed between the location where the holding hand (including fingers) abuts the core FC and the upper surface 321 of the shaft tip part 230 when the portion of the film roll FR is inserted onto the shaft tip part 230.

Consequently, it is not simple to place the portion of the film roll FR on the projection part 270 (the shaft tip part 230) after it is inserted onto the shaft tip part 230.

Thus, the film roll supporting device 10 is excellent in the operability in the mounting operation of the film roll FR compared to the case in which the film roll FR is mounted on the conventional shaft 220.

(4-4)

In the film roll supporting device 10, the cutout 80 recessed in the down direction (in the direction intersecting the axis A1 direction of the shaft body part 20) from the tip (i.e., the upper end) of the projection part 70 is formed in the projection part 70. Consequently, during the mounting operation of the film roll FR, when the film roll FR is inserted onto the shaft tip part 30, a movement path for the holding hand on the introduction side is formed in the projection part 70. Specifically, as indicated by the double-dashed line arrow in FIG. 16, the holding hand (including fingers) on the introduction side is able to move. Therefore, when the film roll FR is inserted onto the shaft tip part 30, the contact between the holding hand on the introduction side and the projection part 70 is restrained, so that it is excellent in the operability in the mounting operation of the film roll FR.

(4-5)

In the film roll supporting device 10, the shaft tip part 30 is relatively rotatable about the shaft body part 20. Moreover, the center of gravity of the shaft tip part 30 is positioned such that the tip of the projection part 70 upwardly faces and the cutout 80 formed in the projection part 70 is recessed downwardly when the shaft tip part 30 is in the stationary state (in the state in which it does not rotate). According to this, the shaft tip part 30 keeps its orientation as shown in FIGS. 10 and 11 when it is stationary.

Consequently, during the mounting operation of the film roll FR, when the film roll FR is provisionally placed on the shaft tip part 30, it is not necessary, before the operation, to adjust a position of the shaft tip part 30 such that the tip of the projection part 70 upwardly faces and the cutout 80 is recessed downwardly. Moreover, after portion of the film roll FR being inserted onto the shaft tip part 30, until being placed on the projection part 70, even if the operator contacts the shaft tip part 30 or the like to rotate the shaft tip part 30, it automatically stops in the state in which the tip of the projection part 70 upwardly faces and the cutout 80 is recessed downwardly. Therefore, it is not necessary to stop the operation to adjust the position of the shaft tip part 30.

Accordingly, it is excellent in the operability in the mounting operation of the film roll FR.

(4-6)

In the above embodiment, the joining portion 31 of the shaft tip part 30 has the guide surface 311 downwardly inclined and extending toward the projection part 70 in the stationary state. Consequently, as indicated by the dashed line arrow in FIG. 17, when the portion of the film roll FR is provisionally placed on the shaft tip part 30 and the entire of the film roll FR is slid to the installation position, the film roll FR that is in movement abuts the guide surface 311 and is guided toward the shaft body part 20. Therefore, when the portion of the film roll FR is provisionally placed on the shaft tip part 30 and the entire of the film roll FR is slid to the installation position, it is possible to perform smooth sliding without a force for lifting the entire of the film roll FR.

Accordingly, it is excellent in the operability in the mounting operation of the film roll FR.

(5) Characteristics (5-1)

In the above embodiment, since the projection part 70 is provided, when the portion of the film roll FR is provisionally placed on the shaft tip part 30, the clearance CL1 (see FIG. 12) equivalent to the distance between the tip of the projection part 70 and the shaft tip part 30 is left between the core FC and the shaft tip part 30 in the central hole H1 being inserted by the shaft tip part 30. Consequently, in the state in which the portion of the film roll FR is placed on the projection part 70, it is easy for the holding hand (i.e., a hand for provisionally placing) on the introduction side of the film roll FR to release from the film roll FR. Accordingly, in the mounting operation of the film roll FR, it is easy to provisionally place the film roll FR on the shaft tip part 30.

Moreover, since the cutout 80 is formed in the projection part 70, when the film roll FR is inserted onto the shaft tip part 30, the movement path for the hand (including fingers) holding the film roll FR on the introduction direction side is formed in the projection part 70. Consequently, when the film roll FR is inserted onto the shaft tip part 30, the hand holding the film roll FR is able to pass the projection part 70 via the cutout 80. Therefore, the contact between the hand holding the film roll FR and the projection part 70 is restrained. Accordingly, it is easy to insert the film roll FR onto the shaft 12.

(5-2)

In the above embodiment, the shaft tip part 30 (the extending portion 32) has the upper surface 321 extending at the height position lower than the central axis (i.e., the axis A1) of the shaft body part 20 in the state in which the tip of the projection part 70 upwardly faces. According to this, in the state in which the core FC of the film roll FR is placed on the projection part 70, the space for accommodating the holding hand (including fingers) on the introduction side of the film roll FR is left. Consequently, when the portion of the film roll FR is provisionally placed on the shaft tip part 30, the contact between the holding hand on the introduction side of the film roll FR and the projection part 70 is restrained. Accordingly, in the mounting operation of the film roll FR, it is easy to provisionally place the film roll FR on the shaft tip part 30.

(5-3)

In the above embodiment, the shaft tip part 30 has the length L2 in the axis A1 direction longer than the length L5 of the projection part 70 in the longitudinal direction. According to this, in the state in which the portion of the film roll FR is placed on the projection part 70, it is possible to adequately largely leave the space (the clearance CL2, see FIG. 14) for accommodating the hand (including fingers) holding the film roll FR on the introduction side. Consequently, when the portion of the film roll FR is provisionally placed on the shaft tip part 30, the contact between the holding hand on the introduction side of the film roll FR and the projection part 70 is restrained. Accordingly, in the mounting operation of the film roll FR, it is further easy to provisionally place the film roll FR on the shaft tip part 30.

(5-4)

In the above embodiment, the projection part 70 is rotatable around the axis A1 direction of the shaft body part 20. According to this, when the mounting operation of the film roll FR is performed, the position of the projection part 70 and the position of the cutout 80 are able to be adjusted as appropriate. That is to say, when the mounting operation of the film roll FR is performed, it is possible to adjust the position of the projection part 70 so that the film roll FR is readily inserted onto the shaft tip part 30. Moreover, it is possible to adjust the position of the projection part 70 so that the film roll FR is readily provisionally placed on the shaft tip part 30.

(5-5)

In the above embodiment, the center of gravity of the shaft tip part 30 is positioned such that the projection part 70 upwardly faces and the cutout 80 is recessed downwardly when the shaft tip part 30 is in the stationary state. According to this, regardless of the rotation of the shaft body part 20, the cutout 80 of the projection part 70 is recessed downwardly. Consequently, when the mounting operation of the film roll FR is performed, it is not necessary to adjust the position of the shaft tip part 30 before the operation. Moreover, if, during the operation, the shaft body part 20 rotates due to the contact or the like, it is not necessary to stop the operation to adjust the position of the shaft tip part 30. Accordingly, it is excellent in the operability in the mounting operation of the film roll FR.

(5-6)

In the above embodiment, the joining portion 31 of the shaft tip part 30 has the guide surface 311 that is downwardly inclined and extends toward the projection part 70 (more specifically, to the portion connected to the extending portion 32) in the stationary state. Since, during the mounting of the film roll FR, the guide surface 311 abuts the film roll FR that is in movement and guide the film roll FR toward the shaft body part 20, when the portion of the film roll FR is provisionally placed on the shaft tip part 30 and the entire of the film roll FR is slid to the installation position, it is possible to perform smooth sliding without a force lifting the entire of the film roll FR.

(5-7)

In the above embodiment, the shaft tip part 30 has the plate-shaped extending portion 32 extending in the direction opposite to the shaft body part 20 from the joining portion 31; the projection part 70 extends from the extending portion 32; and the guide surface 311 is inclined and extends to the portion connected to the extending portion 32. According to this, in the state in which the portion of the film roll FR is placed on the projection part 70, it is possible to adequately largely leave the space (the clearance CL1, see FIG. 12), for accommodating the hand (including fingers) holding the film roll FR on the introduction side. Consequently, when the portion of the film roll FR is provisionally placed on the shaft tip part 30, the contact between the holding hand on the introduction side of the film roll FR and the projection part 70 is further restrained. Accordingly, in the mounting operation of the film roll FR, it is further easy to provisionally place the film roll FR on the shaft tip part 30.

(5-8)

In the above embodiment, the shaft body part 20 is configured to be pivotal together with the base part 11 (see FIG. 8). According to this, when the mounting operation of the film roll FR is performed, the shaft tip part 30 is able to pivot to a position at which the film roll FR is readily inserted before the operation. Accordingly, it is excellent in the operability in the mounting operation of the film roll FR.

(6) Modifications

The film roll supporting device 10 of the above embodiment may be modified as appropriate as described in the modifications below. It should be noted that each of the modifications may be applied in combination with other modifications in a range that does not produce inconsistency.

(6-1) Modification A

In the above embodiment, the film roll supporting device 10 is applied to the bag making and packaging machine 100. However, it is not limited thereto and may be applied to other applicable apparatuses.

(6-2) Modification B

In the above embodiment, the shaft tip part 30 has the length L2 in the axis A1 direction longer than the length L5 of the projection part 70 in the longitudinal direction. However, the shaft tip part 30 may not necessarily be configured in a manner to have the length L2 in the axis A1 direction longer than the length L5 of the projection part 70 in the longitudinal direction.

(6-3) Modification C

In the above embodiment, the projection part 70 is configured to be rotatable around the axis A1 direction of the shaft body part 20. However, the projection part 70 may not necessarily be configured to be rotatable.

(6-4) Modification D

In the above embodiment, the center of gravity of the shaft tip part 30 is positioned such that the projection part 70 upwardly faces and the cutout 80 is recessed downwardly when the shaft tip part 30 is in the stationary state. However, the center of gravity of the shaft tip part 30 may not necessarily be configured in a manner positioned as described above.

(6-5) Modification E

In the above embodiment, the joining portion 31 of the shaft tip part 30 has the guide surface 311 that is downwardly inclined and extending toward the projection part 70 (more specifically, the portion connected to the extending portion 32) in the stationary state. However, the joining portion 31 may not necessarily be configured to have the guide surface 311 made in a manner as described above.

(6-6) Modification F

In the above embodiment, the shaft tip part 30 has the plate-shaped extending portion 32 that extends in the direction opposite to the shaft body part 20 from the joining portion 31; the projection part 70 that extends from the extending portion 32; and the guide surface 311 that is inclines and extends to the portion connected to the extending portion 32. However, the extending portion 32 may be omitted as appropriate. In such a case, the projection part 70 may be positioned in the joining portion 31 (specifically, it may upwardly extend from the lower end of the guide surface 311) as shown in a shaft 12*a* in FIG. 18.

(6-7) Modification G

In the above embodiment, the shaft body part 20 is configured to be pivotal together with the base part 11 (see FIG. 8). However, the shaft body part 20 may not necessarily be configured to be pivotal together with the base part 11.

(6-8) Modification H

Figure 19:
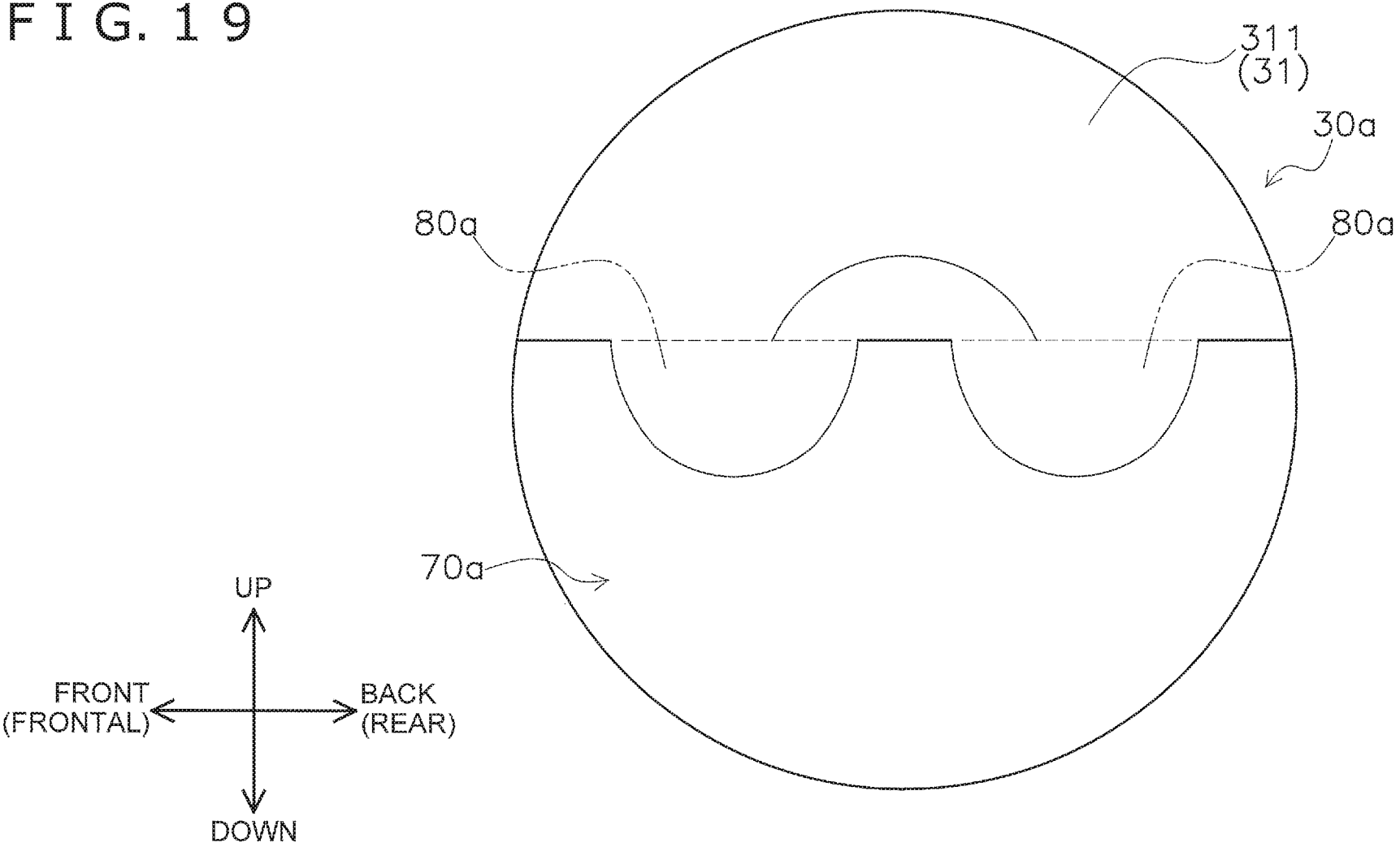
FIG. 19 is an enlarged view of a projection part according to modification H in the left side view.

In the above embodiment, one cutout 80 recessed in the down direction (in the direction intersecting the axis A1 direction) is formed in the projection part 70. However, two or more cutouts may be formed in the projection part 70. In such a case, the projection part 70 may be configured like a projection part 70*a* as shown in FIG. 19.

Two cutouts 80*a* recessed in the down direction (in the direction intersecting the axis A1 direction) are formed in the projection part 70*a*. The projection part 70*a* thus having a plurality of the cutout 80*a* achieves the same effects as the above embodiment.

That is to say, since the plurality of the cutout 80*a* are formed in the projection part 70*a*, when the film roll FR is inserted onto a shaft tip part 30*a*, a movement path for a hand (including fingers) holding the film roll FR on the introduction side are formed in the projection part 70*a*. Consequently, when the film roll FR is inserted onto the shaft tip part 30*a*, the hand holding the film roll FR is able to pass the projection part 70*a* via the cutouts 80*a*. Therefore, the contact between the hand holding the film roll FR and the projection part 70*a* is restrained. Accordingly, it is easy to insert the film roll FR onto the shaft 12.

(6-9) Modification I

Figure 20:
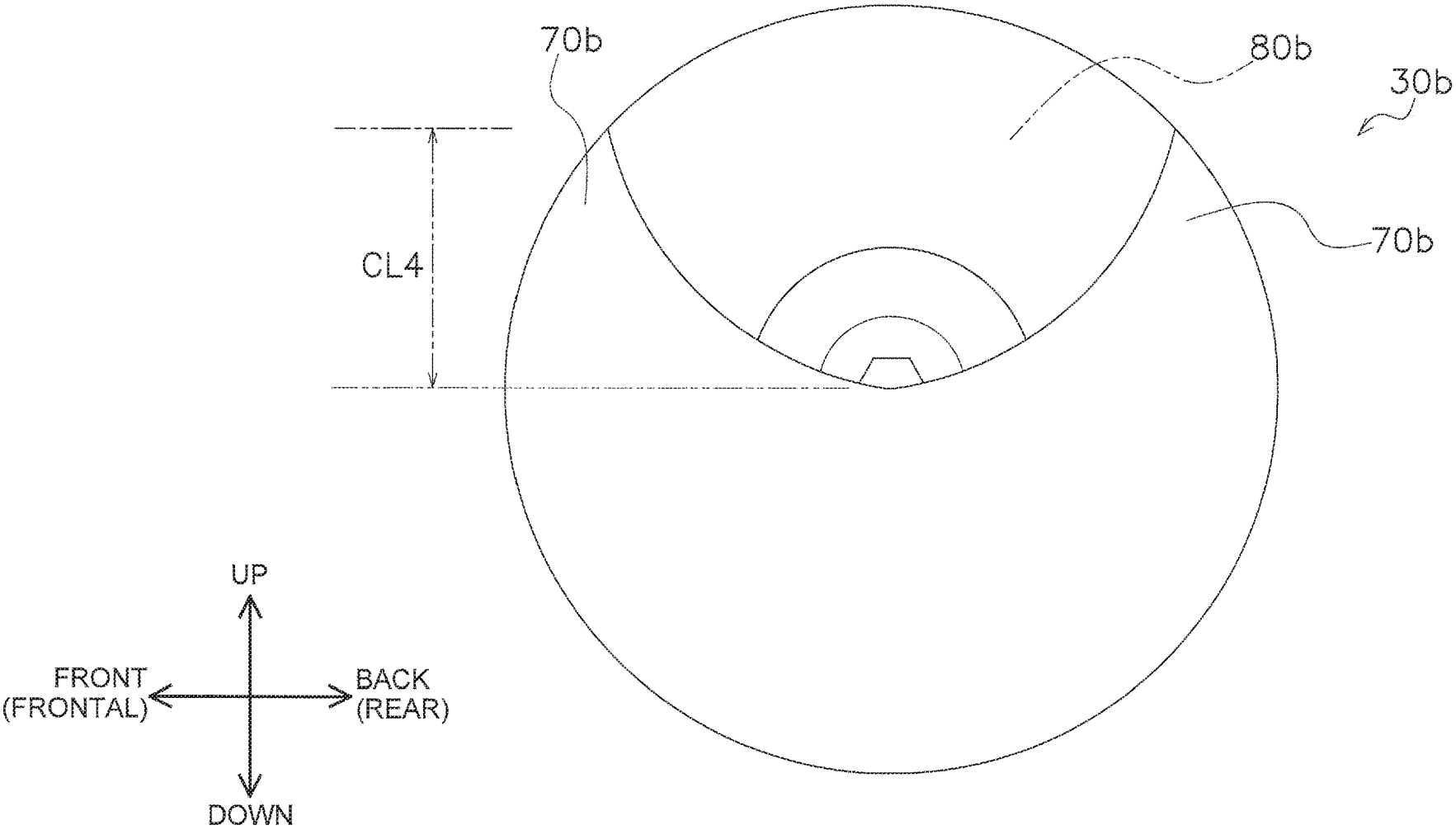
FIG. 20 is an enlarged view of a shaft tip part and a projection part according to modification I in the left side view.
Figure 21:
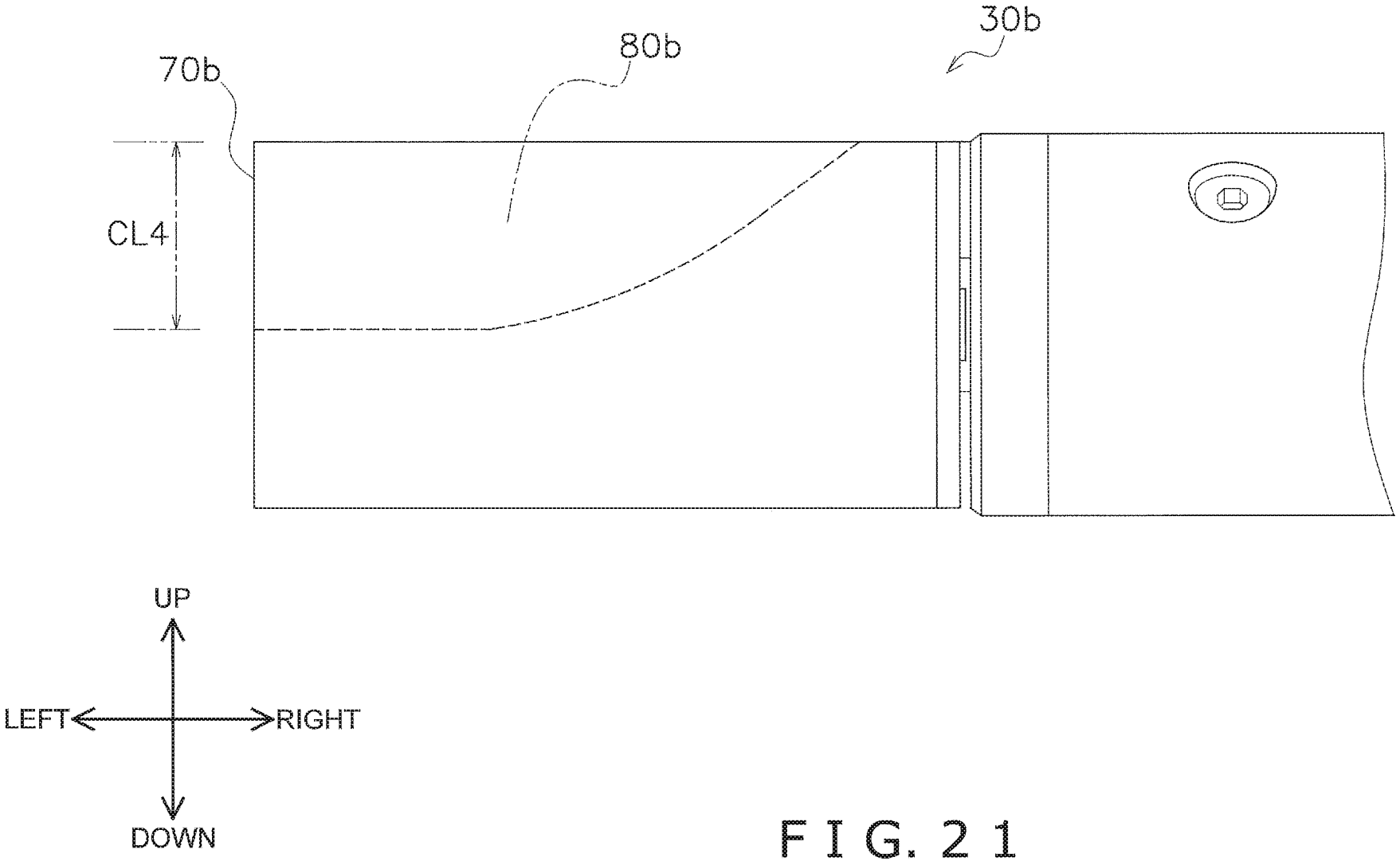
FIG. 21 is an enlarged view of the shaft tip part and the projection part according to modification I in the back view.

In the above embodiment, the shaft tip part 30 is configured in a manner as shown in FIGS. 10 and 11. However, it is not limited thereto and may be configured as a shaft tip part 30*b* as shown in FIGS. 20 and 21.

A cutout 80*b* is substantially elliptical in shape in the left side view and recessed in substantially trapezoidal in shape in the back view, and is formed in the shaft tip part 30*b*. According to this, a projection part 70*b* is formed. Put another way, the cutout 80*b* is formed in the projection part 70*b*. The shaft tip part 30*b* also achieves the same effects as the above embodiment.

That is to say, since the projection part 70*b* is provided, when the portion of the film roll FR is provisionally placed on the shaft tip part 30*b*, a clearance CL4 (see FIGS. 20 and 21) equivalent to a distance between a tip of the projection part 70*b* and the shaft tip part 30*b* is left between the core FC and the shaft tip part 30*b* in the central hole H1 being inserted by the shaft tip part 30*b*. Consequently, in the state in which the portion of the film roll FR is placed on the projection part 70*b*, it is easy for a holding hand (including fingers) on the introduction side to release from the film roll FR. Accordingly, in the mounting operation of the film roll FR, it is easy to provisionally place the film roll FR on the shaft tip part 30*b*.

Moreover, since the cutout 80*b* is formed in the projection part 70*b*, when the film roll FR is inserted onto the shaft tip part 30*b*, a movement path for the hand (including fingers) holding the film roll FR on the introduction side is formed in the projection part 70*b*. Consequently, when the film roll FR is inserted onto the shaft tip part 30*b*, the hand holding the film roll FR is able to pass the projection part 70*b* via the cutout 80*b*. Therefore, the contact between the projection part 70*b* and the hand holding the film roll FR is restrained. Accordingly, it is easy to insert the film roll FR onto the shaft 12.

(6-10) Modification J

Figure 22:
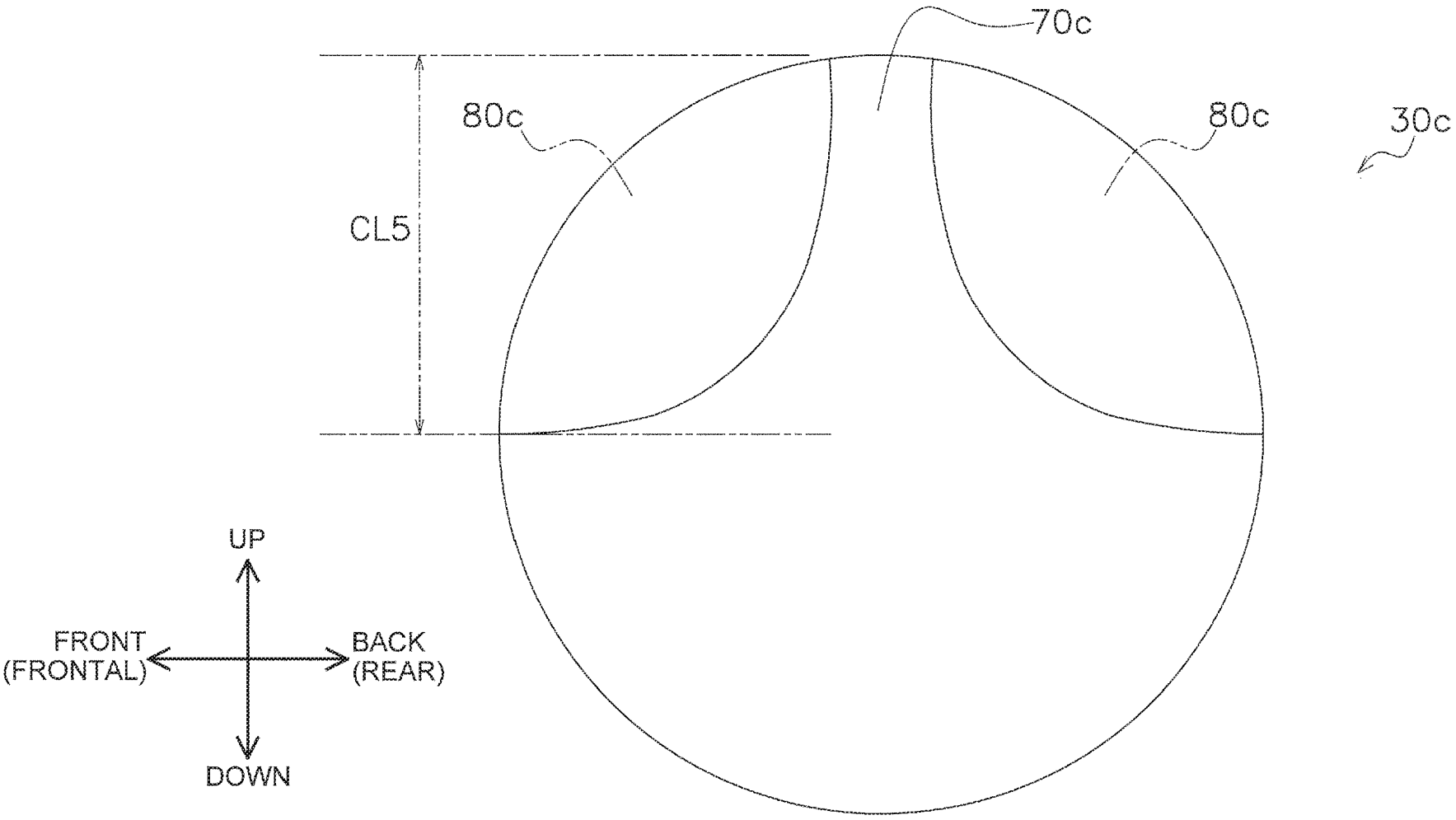
FIG. 22 is an enlarged view of a shaft tip part and a projection part according to modification J in the left side view.
Figure 23:
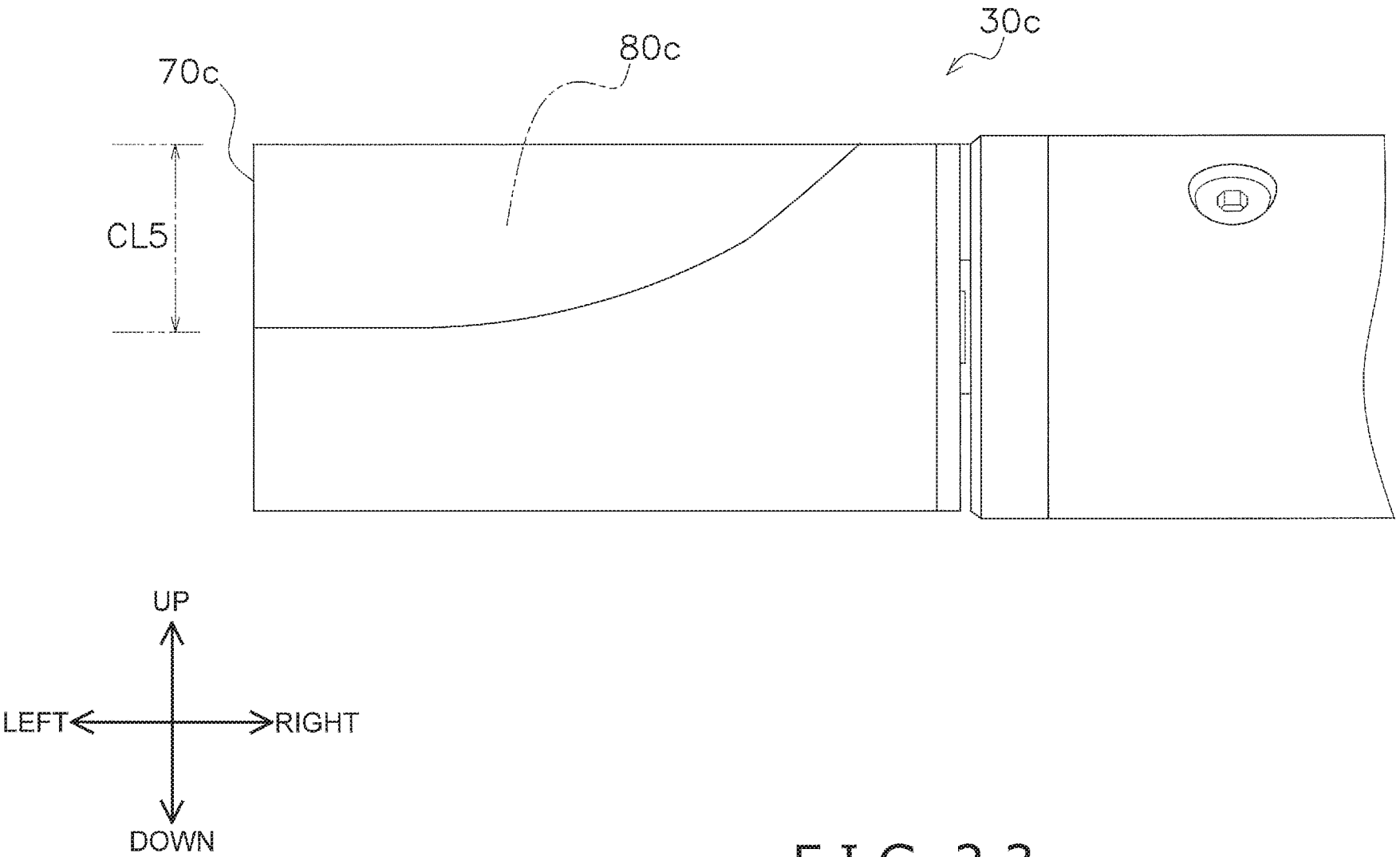
FIG. 23 is an enlarged view of the shaft tip part and the projection part according to modification J in the back view.

The shaft tip part 30 may be configured like a shaft tip part 30*c* as shown in FIGS. 22 and 23.

Two cutouts 80*c* are substantially elliptical in shape in the left side view and recessed in substantially trapezoidal in shape in the back view, and are formed in the shaft tip part 30*c*. Thus, a projection part 70*c* is formed. Put another way, each cutout 80*c* are formed in the projection part 70*c*. The shaft tip part 30*c* achieves the same effects as the above embodiment.

That is to say, since the projection part 70*c* is provided, when the portion of the film roll FR is provisionally placed on the shaft tip part 30*c*, a clearance CL5 (see FIGS. 22 and 23) equivalent to a distance between a tip of the projection part 70*c* and the shaft tip part 30*c* is left between the core FC and the shaft tip part 30*c* in the central hole H1 being inserted by the shaft tip part 30*c*. Consequently, in the state in which the portion of the film roll FR is placed on the projection part 70*c*, it is easy for a hand (including fingers) holding the film roll FR on the introduction side to release from the film roll FR. Accordingly, in the mounting operation of the film roll FR, it is easy to provisionally place the film roll FR on the shaft tip part 30*c*.

Moreover, since the cutouts 80*c* are formed in the projection part 70*c*, when the film roll FR is inserted onto the shaft tip part 30*c*, a movement path for the hand (including fingers) holding the film roll FR on the introduction side are formed in the projection part 70*c*. Consequently, when the film roll FR is inserted onto the shaft tip part 30*c*, the hand holding the film roll FR is able to pass the projection part 70*c* via the cutouts 80*c*. Therefore, the contact between the hand holding the film roll FR and the projection part 70*c* is restrained. Accordingly, it is easy to insert the film roll FR onto the shaft 12.

(6-11) Modification K

In the above embodiment, the projection part 70 is extruded or the like and thus configured integrally with the extending portion 32 (the shaft tip part 30). However, the projection part 70 may not necessarily be configured integrally with the extending portion 32. The projection part 70 shaped independently of the extending portion 32 may be configured to be secured to the extending portion 32.

(6-12) Modification L

In the above embodiment, the distance d3 between the upper surface 321 of the extending portion 32 and the axis A1 is set to 20 mm. However, the distance d3 may be modified as appropriate, and may be set to 20 mm or longer/shorter than 20 mm. For example, the distance d3 may be set to 25 mm or 15 mm.

(6-13) Modification M

Figure 24:
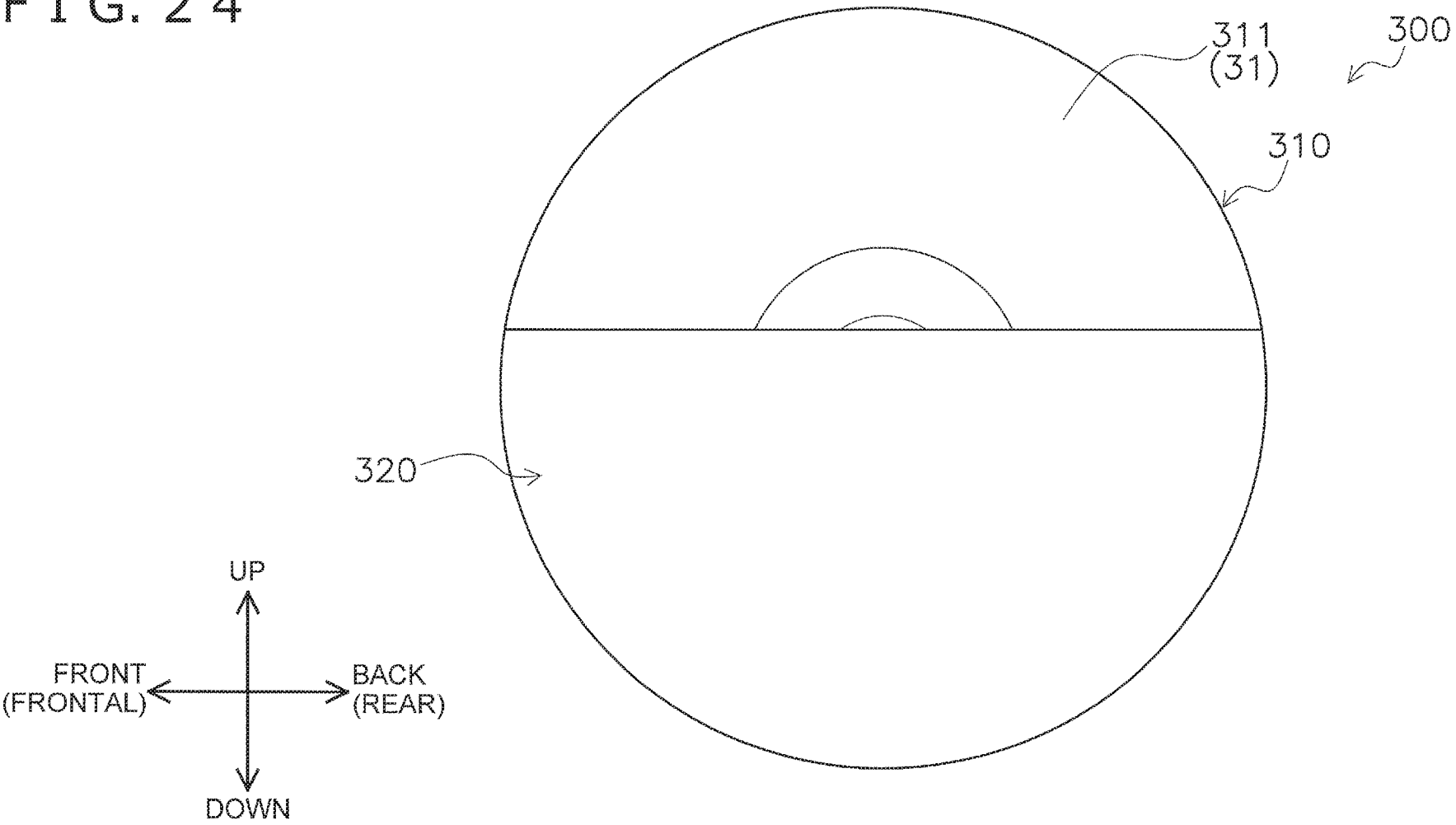
FIG. 24 is an enlarged view of a shaft tip part and a projection part according to modification M in the left side view.

Moreover, the shaft 12 of the above embodiment may be configured like a shaft 300 as shown in FIG. 24. FIG. 24 is an enlarged view of a shaft tip part 310 and a projection part 320 of the shaft 300 in the left side view.

The shaft 300 has the shaft tip part 310 instead of the shaft tip part 30 and has the projection part 320 instead of the projection part 70.

Unlike the projection part 70, the cutout 80 is not formed in the projection part 320. Therefore, in the shaft 300, when the film roll FR is inserted onto the shaft tip part 310, a movement path for a hand (including fingers) holding the film roll FR on the introduction side is not formed in the projection part 320. Consequently, when the film roll FR is inserted onto the shaft tip part 310, the feature (i.e., like the feature as described in (4-4)) of enabling the hand holding the film roll FR to pass the projection part 320 via this cutout is not achieved.

However, the shaft 300 achieves the other features (for example, like the features as described in (4-1), (4-2), (4-3), (4-5), and (4-6)) similarly to the shaft 12.

Accordingly, in the shaft 300, in the mounting operation of the film roll FR, it is easy to provisionally place the film roll FR on the shaft tip part 310, so that it is excellent in the operability in the mounting operation of the film roll FR.

The invention claimed is:

1. A film roll supporting device, comprising:

a cylindrical shaft body part, the shaft body part having a longitudinal central axis centered along a length of the shaft body part, the shaft body part having a first end and a second end that are spaced from one another along the longitudinal central axis;

a shaft tip part extending from the second end of the shaft body part along the longitudinal central axis, the shaft tip part including a clearance that has a first end that extends downwardly from the longitudinal central axis proximate to the second end of the shaft body part, defining a bottom upper surface that lies below the longitudinal central axis, and a second end that extends upwardly toward the longitudinal central axis, the second end of the clearance being spaced from the first end of the clearance, the shaft tip part terminating in an upwardly-extending projection that arises from the second end of the clearance and extends above the longitudinal central axis, and the upwardly-extending projection including a recessed cutout formed at an upper end thereof.

2. The film roll supporting device according to claim 1, wherein:

the shaft tip part is joined to the shaft body part rotatably and is configured to rotate around the longitudinal central axis of the shaft body part, the upwardly-extending projection is configured integrally with the shaft tip part and rotates together with the shaft tip part, and a center of gravity of the shaft tip part is positioned such that the upwardly-extending projection faces upwardly and the recessed cutout is recessed downwardly when the shaft tip part is in a stationary state.

3. The film roll supporting device according to claim 1, wherein the shaft tip part has a length longer than a length of the upwardly-extending projection in a longitudinal direction parallel to the longitudinal central axis.

4. The film roll supporting device according to claim 1, wherein the upwardly-extending projection is rotatable around the longitudinal central axis of the shaft body part.

5. The film roll supporting device according to claim 1, wherein:

the shaft tip part includes a joining portion joined to the shaft body part, the joining portion has a guide surface downwardly inclined and extending toward the upwardly-extending projection in a stationary state, and the guide surface is configured to abut a film roll that is in movement to guide the film roll to a shaft body part side during the mounting of the film roll.

6. The film roll supporting device according to claim 5, wherein:

the shaft tip part further includes a plate-shaped extending portion, the plate-shaped extending portion extends in a direction opposite to the shaft body part side from the joining portion, the upwardly-extending projection extends from the plate-shaped extending portion, and the guide surface is inclined and extends to a portion connected to the plate-shaped extending portion.

7. The film roll supporting device according to claim 1, further comprising, a base part pivotally disposed on a frame, the first end of the shaft being secured to the base part, and a drive part positioned in the base part and allowing the shaft body part to rotate around the longitudinal central axis, wherein the shaft body part and the drive part pivot together with the base part.

8. A film roll supporting device, comprising:

a base;

a cylindrical shaft body part supported generally horizontally on the base at a first end of the shaft body part, the shaft body part having a longitudinal central axis centered along a length of the shaft body part, and a second end that is spaced from the first end along the longitudinal central axis;

a shaft tip part extending from the second end of the shaft body part along the longitudinal central axis, the shaft tip part including a clearance that has a first end that extends downwardly from the longitudinal central axis proximate to the second end of the shaft body part, defining a generally horizontal bottom upper surface that lies below the longitudinal central axis, and a second end that extends upwardly toward the longitudinal central axis, the second end of the clearance spaced from the first end of the clearance, the shaft tip part terminating in an upwardly-extending projection that arises from the second end of the clearance and extends above the longitudinal central axis, and the upwardly-extending projection including a recessed cutout formed at an upper end thereof.

9. The film roll supporting device according to claim 8, wherein:

the shaft tip part is joined to the shaft body part rotatably and is configured to rotate around the longitudinal central axis of the shaft body part, the upwardly-extending projection is configured integrally with the shaft tip part and rotates together with the shaft tip part, and a center of gravity of the shaft tip part is positioned such that the upwardly-extending projection faces upwardly and the recessed cutout is recessed downwardly when the shaft tip part is in a stationary state.

10. The film roll supporting device according to claim 8, wherein the shaft tip part has a length longer than a length of the upwardly-extending projection in a longitudinal direction parallel to the longitudinal central axis.

11. The film roll supporting device according to claim 8, wherein the upwardly-extending projection is rotatable around the longitudinal central axis of the shaft body part.

12. The film roll supporting device according to claim 8, wherein:

the shaft tip part includes a joining portion joined to the shaft body part, the joining portion has a guide surface downwardly inclined and extending toward the upwardly-extending projection in a stationary state, and the guide surface is configured to abut a film roll that is in movement to guide the film roll to a shaft body part side during the mounting of the film roll.

13. The film roll supporting device according to claim 12, wherein:

the shaft tip part further includes a plate-shaped extending portion, the plate-shaped extending portion extends in a direction opposite to the shaft body part side from the joining portion, the upwardly-extending projection extends from the plate-shaped extending portion, and the guide surface is inclined and extends to a portion connected to the plate-shaped extending portion.

14. The film roll supporting device according to claim 8, further comprising, a drive part positioned in the base and allowing the shaft body part to rotate around the longitudinal central axis, wherein the shaft body part and the drive part pivot together with the base.

* * * * *